US011768037B2

(12) United States Patent
Yamakoshi et al.

(10) Patent No.: US 11,768,037 B2
(45) Date of Patent: Sep. 26, 2023

(54) DIFFUSION BONDING HEAT EXCHANGER

(71) Applicant: Sumitomo Precision Products Co., Ltd., Amagasaki (JP)

(72) Inventors: Munehisa Yamakoshi, Amagasaki (JP); Yasuhiro Fujita, Amagasaki (JP); Eiji Togo, Amagasaki (JP); Suguru Takahashi, Amagasaki (JP)

(73) Assignee: Sumitomo Precision Products Co., Ltd., Amagasaki (JP)

( * ) Notice: Subject to any disclaimer, the term of this patent is extended or adjusted under 35 U.S.C. 154(b) by 88 days.

(21) Appl. No.: 17/040,622

(22) PCT Filed: Mar. 25, 2019

(86) PCT No.: PCT/JP2019/012531
§ 371 (c)(1),
(2) Date: Sep. 23, 2020

(87) PCT Pub. No.: WO2019/188997
PCT Pub. Date: Oct. 3, 2019

(65) Prior Publication Data

US 2021/0116182 A1 Apr. 22, 2021

(30) Foreign Application Priority Data

Mar. 30, 2018 (JP) ..... 2018-067616

(51) Int. Cl.
*F28D 9/00* (2006.01)
*F28F 3/04* (2006.01)

(52) U.S. Cl.
CPC ..... *F28D 9/0062* (2013.01); *F28F 3/04* (2013.01); *F28F 2275/061* (2013.01)

(58) Field of Classification Search
CPC ..... F28F 2260/02; F28F 3/04; F28F 2275/061
See application file for complete search history.

(56) References Cited

U.S. PATENT DOCUMENTS

2001/0051201 A1* 12/2001 Schubert ..... A23L 3/22 426/522
2006/0275185 A1* 12/2006 Tonkovich ..... F28F 13/06 422/503

(Continued)

FOREIGN PATENT DOCUMENTS

JP 9-152291 A 6/1997
JP 2005-180806 A 7/2005

(Continued)

OTHER PUBLICATIONS

Translation of patent Document JP2016183811A entitled Translation—JP2016183811A (Year: 2016).*

(Continued)

*Primary Examiner* — Paul Alvare
(74) *Attorney, Agent, or Firm* — Crowell & Moring LLP

(57) ABSTRACT

A diffusion bonding heat exchanger includes a first heat transfer plate and a second heat transfer plate. A high-temperature flow path of the first heat transfer plate includes a connection channel portion configured such that a high-temperature fluid can flow across a plurality of channels within at least a range that overlaps a predetermined range in a stacking direction, the predetermined range being a range from a flow path inlet of the second heat transfer plate to a position downstream of the flow path inlet.

6 Claims, 7 Drawing Sheets

(56) References Cited

U.S. PATENT DOCUMENTS

| | | | | |
|---|---|---|---|---|
| 2009/0211977 | A1* | 8/2009 | Miller | F28F 3/12 165/170 |
| 2009/0294113 | A1 | 12/2009 | Cha et al. | |
| 2010/0051248 | A1* | 3/2010 | Inatomi | F28F 3/04 165/166 |
| 2015/0316326 | A1* | 11/2015 | Choi | F28D 9/0093 165/166 |
| 2016/0131432 | A1* | 5/2016 | Neumann | F28D 9/0093 29/890.03 |
| 2016/0282064 | A1* | 9/2016 | Yoon | F28F 9/026 |
| 2017/0268826 | A1* | 9/2017 | Noishiki | F28D 9/0093 |
| 2019/0086155 | A1 | 3/2019 | Fujita et al. | |

FOREIGN PATENT DOCUMENTS

| | | | | |
|---|---|---|---|---|
| JP | 2006-170549 | A | | 6/2006 |
| JP | 2008-128574 | A | | 6/2008 |
| JP | 2015-64165 | A | | 4/2015 |
| JP | 2016-183811 | A | | 10/2016 |
| JP | 2016183811 | A | * | 10/2016 |
| JP | 2017-180984 | A | | 10/2017 |
| KR | 20170119246 | A | * | 4/2017 |
| KR | 10-2017-0123146 | A | | 11/2017 |

OTHER PUBLICATIONS

Translation of patent Document KR20170119246A entitled Translation—KR20170119246A (Year: 2017).*

International Search Report (PCT/ISA/210) issued in PCTApplication No. PC17JP2019/012531 dated May 14, 2019 with English translation (five pages).

Japanese-language Written Opinion (PCT/ISA/237) issued in PCTApplication No. PCT/JP2019/012531 dated May 14, 2019 (eight pages).

* cited by examiner (SECOND EMBODIMENT)

(SECOND EMBODIMENT)

(MODIFICATION EXAMPLE)

(MODIFICATION EXAMPLE)

(MODIFICATION EXAMPLE)

DIFFUSION BONDING HEAT EXCHANGER

TECHNICAL FIELD

The present invention relates to a diffusion bonding heat exchanger, particularly, to a diffusion bonding heat exchanger having a configuration in which a plurality of heat transfer plates, in each of which a flow path having a groove shape is formed, are stacked and diffusion-bonded to each other.

BACKGROUND ART

In the related art, there is known a diffusion bonding heat exchanger having a configuration in which a plurality of heat transfer plates, in each of which a flow path having a groove shape is formed, are stacked and diffusion-bonded to each other. Such a diffusion bonding heat exchanger is disclosed in Japanese Unexamined Patent Application Publication No. 2017-180984.

Japanese Unexamined Patent Application Publication No. 2017-180984 discloses a heat exchanger including a core obtained by alternately stacking and diffusion-bonding a first heat transfer plate and a second heat transfer plate to each other. The first heat transfer plate and the second heat transfer plate are formed of stainless steel, and each of the first heat transfer plate and the second heat transfer plate is provided with a plurality of fluid path portions. The fluid path portion is composed of a flow path (channel) that is formed as a recessed groove at a surface of the heat transfer plate and connects an inlet and an outlet for a fluid. The flow path has a plurality of branches between the inlet and the outlet. The plurality of branches extend linearly and are arranged at intervals.

CITATION LIST

Patent Literature

[PTL 1] Japanese Unexamined Patent Application Publication No. 2017-180984

SUMMARY OF INVENTION

Technical Problem

The diffusion bonding heat exchanger as disclosed in Japanese Unexamined Patent Application Publication No. 2017-180984 is high in strength since the metal heat transfer plates are integrated with each other through diffusion bonding and is a device that is small in comparison with a general heat exchanger. Since the diffusion bonding heat exchanger can withstand a large thermal stress, the diffusion bonding heat exchanger is suitable for the purpose of heat exchange between fluids significantly different from each other in temperature. Such purposes include vaporization or an increase in temperature of a very low-temperature fluid such as a liquefied natural gas (LNG) and liquid hydrogen. In this case, generally, water, antifreeze, or the like is used as a high-temperature fluid serving as a heat source.

However, in a case where a very low-temperature liquefied gas is caused to flow as a low-temperature fluid, freezing (solidification) of a high-temperature fluid such as water or an ethylene glycol solution may occur in a flow path of a heat transfer plate such that the flow path is partially closed. Particularly, at a high-temperature fluid side flow path disposed at a position overlapping the vicinity of a low-temperature fluid inlet, freezing is likely to occur since the inlet temperature of the low-temperature fluid is low. Since the diffusion bonding heat exchanger is formed to have a small size, the sectional area of the entire flow path is small and thus there is a disadvantage that influence on the performance (decrease in performance) of the heat exchanger is great in a case where a portion of the flow path is closed. In addition, when freezing of the high-temperature fluid occurs once, flowing thereof is suppressed at a position downstream of a frozen portion and thus expansion of a frozen region may occur starting from the frozen portion in the flow path.

Therefore, it is desired that freezing in a flow path on a high-temperature fluid side can be suppressed in a diffusion bonding heat exchanger in which a fluid having a very low temperature is handled and expansion of a frozen region can be suppressed even in the case of freezing.

The invention has been made to solve problems as described above and an object of the invention is to provide a diffusion bonding heat exchanger with which it is possible to suppress freezing in a flow path on a high-temperature fluid side in a case where a fluid having a very low temperature is handled and to suppress expansion of a frozen region even in the case of freezing.

Solution to Problem

In order to achieve the above-described object, the invention provides a diffusion bonding heat exchanger including a core that includes a first heat transfer plate and a second heat transfer plate that are stacked and diffusion-bonded to each other, in which the first heat transfer plate includes a high-temperature flow path that includes a plurality of channels having a groove shape provided to be arranged in a flow path width direction and through which a high-temperature fluid flows, the second heat transfer plate includes a low-temperature flow path through which a low-temperature fluid flows, and the high-temperature flow path of the first heat transfer plate includes a connection channel portion configured such that the high-temperature fluid flows across the plurality of channels within at least a range that overlaps a predetermined range in a stacking direction, the predetermined range being a range from a flow path inlet of the second heat transfer plate to a position downstream of the flow path inlet. Note that, in the present specification, the expressions "high-temperature fluid" and "low-temperature fluid" are used to show a relative difference between the temperatures thereof and does not mean being at specific temperatures as absolute values. In addition, in the present specification, the expression "channel" means each of path portions partitioned by a partition wall defining the inside of a flow path in the flow path width direction orthogonal to a flowing direction of a fluid. According to the above-described configuration, the plurality of channels communicate with each other at least in the connection channel portion. Therefore, each channel is not one independent path from the flow path inlet to a flow path outlet. That is, each channel may branch or join another channel in an area from the flow path inlet to the flow path outlet.

In the diffusion bonding heat exchanger according to the invention, as described above, the connection channel portion configured such that the high-temperature fluid flows across the plurality of channels within at least the range in the high-temperature flow path that overlaps the predetermined range (vicinity of inlet of low-temperature flow path) is provided, the predetermined range being a range from the flow path inlet of the second heat transfer plate to the position downstream of the flow path inlet. Accordingly, in a range in the high-temperature flow path that overlaps the predetermined range at which the temperature becomes lowest, there is an increase in heat transfer area (area of channel inner surface) in comparison with a configuration in which the channels are independent of each other and a stream close to turbulence is generated due to a stream across the channels. Therefore, it is possible to improve the heat transfer rate in the connection channel portion. As a result, there is an increase in amount of heat input to the first heat transfer plate in which the high-temperature flow path is formed and thus the temperature of an inner surface of the high-temperature flow path can be made high. Therefore, it is possible to suppress freezing in the high-temperature flow path. In addition, even in a case where freezing (solidification) of the high-temperature fluid occurs in the connection channel portion and a portion of the channels is closed, the high-temperature fluid flowing through another channel can flow around to a downstream side of the channel that is closed by flowing across the channels. As a result, it is possible to suppress expansion of a frozen portion caused by suppression of a stream of the high-temperature fluid in the vicinity of the frozen portion. Furthermore, when a portion of the channels is closed due to freezing, the flow path sectional area of the high-temperature flow path is decreased corresponding to the freezing and the flow rate of the high-temperature fluid in the channels that are not frozen is increased. As a result, the heat transfer rate in the channels that are not frozen is improved and there is an increase in amount of heat input to the first heat transfer plate. Therefore, expansion of the frozen portion of the high-temperature fluid is suppressed. Accordingly, it is possible to suppress freezing in a flow path on the high-temperature fluid side in a case where a fluid having a very low temperature is handled and to suppress expansion of a frozen region even in the case of freezing.

In the diffusion bonding heat exchanger according to the invention, the connection channel portion is preferably formed over the approximately entire high-temperature flow path in the first heat transfer plate. According to such a configuration, the effect achieved by the connection channel portion can be realized over the entire high-temperature flow path instead of being realized over only the predetermined range (vicinity of inlet of low-temperature flow path). The predetermined range in which freezing is likely to occur in the high-temperature flow path can be determined in advance through an experiment or a simulation performed under operating conditions set in design specifications. However, during an actual operation, there are various variation factors that cannot be grasped in advance and thus the frozen portion may become larger than as expected. In such a case, since the connection channel portion is formed over the approximately entire high-temperature flow path in the above-described configuration, it is possible to reliably suppress freezing and expansion of a frozen portion even in a case where a frozen portion different from as expected is generated.

In the diffusion bonding heat exchanger according to the invention, the high-temperature flow path preferably includes the plurality of channels having a linear shape arranged in the flow path width direction and in the connection channel portion, a plurality of connection paths having a groove shape, each of which extends across the channels adjacent to each other such that the channels communicate with each other, are preferably formed. According to such a configuration, it is possible to easily configure the connection channel portion only by forming the connection paths having the groove shape such that the channels composed of linear grooves are connected to each other. Particularly, since groove structures constituting the linear channels and the connection paths can be collectively formed in a case where the high-temperature flow path is formed with respect to the first heat transfer plate through etching or the like, it is possible to suppress a manufacturing step being complicated even in a case where the connection channel portion is to be provided.

In this case, the plurality of connection paths are preferably arranged in a zigzag such that positions of the connection paths adjacent to each other in the flow path width direction are offset from each other in a flowing direction of the high-temperature fluid. In the present specification, "being arranged in a zigzag" means to alternate and means that the positions of odd-numbered connection paths in the flow path width direction and the positions of even-numbered connection paths in the flow path width direction alternate in the flowing direction, for example. According to such a configuration, in comparison with a case where the connection paths are arranged linearly in the flow path width direction, it is possible to cause the high-temperature fluid to move in the flow path width direction more efficiently. As a result, it is possible to achieve an improvement in heat transfer efficiency of the connection channel portion and to prompt the high-temperature fluid to flow around the vicinity of a frozen portion in the connection channel portion.

In the diffusion bonding heat exchanger according to the invention, the high-temperature flow path preferably includes the plurality of channels that branch along a plurality of partition walls having an island shape, which are disposed to be scattered in the flow path, and join each other in the connection channel portion. According to such a configuration as well, the high-temperature fluids can flow across the plurality of channels by branching or joining each other due to the partition walls having the island shape and thus it is possible to configure the connection channel portion.

In the diffusion bonding heat exchanger according to the invention, the high-temperature flow path preferably includes an overlapping region that overlaps the low-temperature flow path of the second heat transfer plate as seen in plan view and a non-overlapping region that is provided outside the overlapping region at least on the flow path inlet side of the low-temperature flow path. According to such a configuration, since the non-overlapping region overlaps a portion where no low-temperature fluid flows on the low-temperature flow path side, the high-temperature fluid flowing through the non-overlapping region does not contribute to heat exchange between the high-temperature fluid that much and the low-temperature fluid and becomes a surplus high-temperature fluid. Therefore, with the non-overlapping region being disposed on the flow path inlet side of the low-temperature flow path, a stream of the surplus high-temperature fluid can be formed at a portion where the temperature of the high-temperature fluid is decreased (portion overlapping predetermined range in vicinity of flow path inlet of low-temperature flow path). Therefore, it is possible to achieve an increase in thermal capacity of the high-temperature fluid corresponding to the amount of the surplus high-temperature fluid flowing through the non-overlapping region. In addition, even when the non-overlapping region is frozen, a stream of the high-temperature fluid can be formed at a position downstream of a frozen portion with the high-temperature fluid flowing around the frozen portion. As a result, a stream of the surplus high-temperature fluid can be formed near a region where freezing is likely to occur and on a downstream side, and thus freezing in the high-temperature flow path at the portion overlapping the predetermined range in the vicinity of the flow path inlet of the low-temperature flow path and expansion of a frozen portion can be effectively suppressed.

In the diffusion bonding heat exchanger according to the invention, the low-temperature flow path preferably includes a first portion that is provided in the predetermined range of the second heat transfer plate and a second portion that is provided downstream of the first portion and the first portion is preferably configured such that a heat transfer performance of the first portion is lower than a heat transfer performance of the second portion. Note that, in the present specification, the heat transfer performance is a comprehensive performance including the movement of heat caused by each of heat conduction, heat transfer (convective heat transfer), and heat radiation. According to such a configuration, the heat transfer performance of the low-temperature flow path is suppressed by the first portion in the predetermined range (vicinity of inlet of low-temperature flow path at which temperature becomes lowest) from the flow path inlet of the low-temperature flow path to the position downstream of the flow path inlet and thus it is possible to increase the surface temperature of the high-temperature flow path side overlapping the predetermined range corresponding thereto. As a result, it is possible to effectively suppress freezing in a portion of the high-temperature flow path that overlaps the predetermined range in the vicinity of the flow path inlet of the low-temperature flow path.

In this case, the low-temperature flow path preferably includes a plurality of channels having a groove shape through which the low-temperature fluid flows and a planar shape of the channels of the first portion is preferably different from a planar shape of the channels of the second portion such that a heat transfer performance of the channels of the first portion is lower than a heat transfer performance of the channels of the second portion. According to such a configuration, it is possible to easily make the heat transfer performance of the first portion lower than the heat transfer performance of the second portion only by making the shapes of the channels constituting the low-temperature flow path different from each other by, for example, making the inner surface area of the channels small, making the width of the channels large, or forming the channels in a linear shape.

The diffusion bonding heat exchanger according to the invention is preferably the diffusion bonding heat exchanger is a parallel flow heat exchanger in which the high-temperature fluid flowing through the high-temperature flow path and the low-temperature fluid flowing through the low-temperature flow path flow in the same direction. According to such a configuration, a flow path inlet of the high-temperature flow path and the flow path inlet of the low-temperature flow path are provided on the same side of the flow paths. Therefore, the high-temperature fluid in a highest-temperature state flows through a position in the high-temperature flow path that overlaps the vicinity of the inlet of the low-temperature flow path and thus freezing of the high-temperature fluid can be effectively suppressed. In addition, during the actual operation of the heat exchanger, the outlet temperatures of the high-temperature fluid and the low-temperature fluid may become lower than as expected due to various variation factors that cannot be grasped in advance. However, the inlet temperatures thereof are not likely to be influenced by such variation factors. Therefore, the influence of the various variation factors is suppressed and a stable freezing-suppressing effect can be achieved.

In the diffusion bonding heat exchanger according to the invention, each of the first heat transfer plate and the second heat transfer plate preferably includes a pair of first side end surfaces and a pair of second side end surfaces adjacent to the first side end surfaces, the high-temperature flow path is preferably formed to extend in a direction along the second side end surfaces from a flow path inlet open at the first side end surface of the first heat transfer plate, and the low-temperature flow path is preferably formed such that the low-temperature flow path is bent after extending from the flow path inlet open at each of the pair of second side end surfaces of the second heat transfer plate and extends in the direction along the second side end surfaces. According to such a configuration, it is possible to provide a flow path inlet for the low-temperature fluid at each of the second side end surfaces on both of right and left sides with respect to a flow path inlet for the high-temperature fluid on the first side end surface side. Therefore, in comparison with a case where only one flow path inlet for the low-temperature fluid is provided on one of the right and left sides, it is possible to decrease the opening area of each flow path inlet and thus it is possible to disperse regions where freezing is likely to occur into both of the right and left sides of the high-temperature flow path while making the regions in the high-temperature flow path small. Accordingly, it is possible to suppress freezing and to make a frozen portion small even in the case of freezing.

Advantageous Effects of Invention

According to the present invention, it is possible to provide a diffusion bonding heat exchanger with which it is possible to suppress freezing in a flow path on a high-temperature fluid side in a case where a fluid having a very low temperature is handled and to suppress expansion of a frozen region even in the case of freezing.

DESCRIPTION OF EMBODIMENTS

Hereinafter, embodiments of the present invention will be described with reference to the drawings.

First Embodiment

With reference to FIGS. 1 to 6, the configuration of a heat exchanger 100 according to a first embodiment will be described. The heat exchanger 100 according to the first embodiment is a diffusion bonding type plate-type heat exchanger configured by stacking first heat transfer plates 10 and second heat transfer plates 20, in each of which a flow path having a groove shape is formed, and integrating the first heat transfer plates 10 and the second heat transfer plates 20 with each other through diffusion bonding. The heat exchanger 100 is an example of a "diffusion bonding heat exchanger" in claims.

Figure 1:
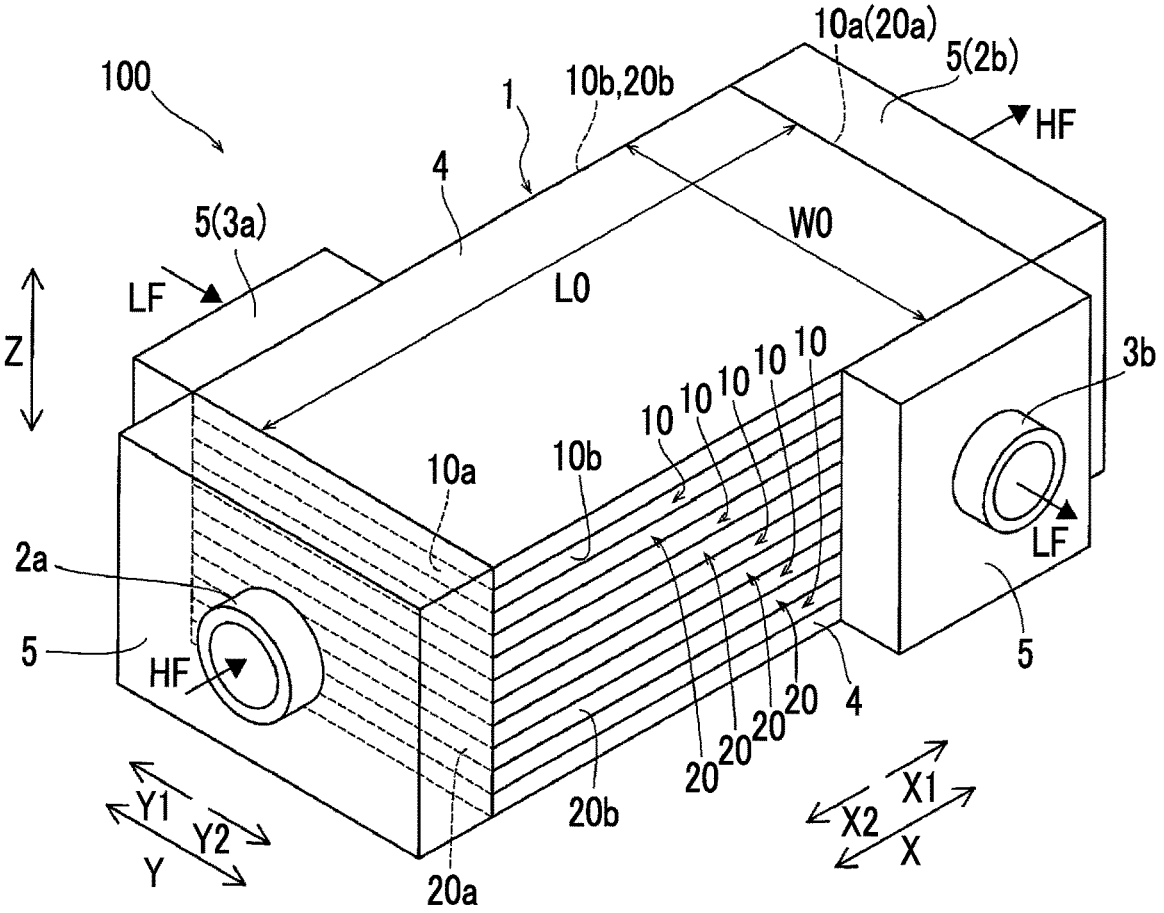
FIG. 1 is a schematic perspective view showing a heat exchanger according to a first embodiment.

As shown in FIG. 1, the heat exchanger 100 includes a core 1 including the first heat transfer plates 10 and the second heat transfer plates 20 that are stacked and diffusion-bonded to each other. In addition, the heat exchanger 100 includes a first inlet port 2*a*, a first outlet port 2*b* (refer to FIG. 3), a second inlet port 3*a* (refer to FIG. 4), and a second outlet port 3*b*. The core 1 includes a plurality of the first heat transfer plates 10 and a plurality of the second heat transfer plates 20. The core 1 is a heat exchange section at which heat exchange is performed between a high-temperature fluid HF flowing through the first heat transfer plates 10 and a low-temperature fluid LF flowing through the second heat transfer plates 20. The first inlet port 2*a* and the first outlet port 2*b* are an inlet for introducing the high-temperature fluid HF into the first heat transfer plates 10 and an outlet for leading out the high-temperature fluid HF from the first heat transfer plates 10 and are provided at an inlet side and an outlet side while forming a pair. The second inlet port 3*a* and the second outlet port 3*b* are an inlet for introducing the low-temperature fluid LF into the second heat transfer plates 20 and an outlet for leading out the low-temperature fluid LF from the second heat transfer plates 20 and are provided at an inlet side and an outlet side while forming a pair.

The heat exchanger 100 in the first embodiment is configured as a vaporization device that vaporizes the low-temperature fluid LF by increasing the temperature of the low-temperature fluid LF through heat exchange between the high-temperature fluid HF and the low-temperature fluid LF. The heat exchanger 100 may be a temperature raising device not causing vaporization. The low-temperature fluid LF is a fluid of which the temperature is lower than the freezing point of the high-temperature fluid HF. The high-temperature fluid HF is a fluid of which the temperature is higher than that of the low-temperature fluid LF. In the first embodiment, the low-temperature fluid LF is a very low-temperature liquefied gas and is, for example, a liquefied natural gas (LNG). Examples of the high-temperature fluid HF include liquid such as water, seawater, and antifreeze.

A side plate 4 is provided at each of opposite ends of the core 1 in a stacking direction (direction Z) of the first heat transfer plates 10 and the second heat transfer plates 20. The first heat transfer plates 10, the second heat transfer plates 20, and the side plates 4 are flat plate members having a plate shape formed in the same rectangular shape as seen in plan view. The core 1 is configured by alternately stacking and diffusion-bonding the first heat transfer plates 10 and the second heat transfer plates 20, in each of which a flow path having a groove shape is formed, to each other. That is, the core 1 is formed in a rectangular box-like shape (rectangular parallelepiped shape) as a whole by causing a stack of the first heat transfer plates 10 and the second heat transfer plates 20, which are alternately stacked, to be interposed between a pair of the side plates 4 and bonding the first heat transfer plates 10, the second heat transfer plates 20, and the side plates 4 to each other through diffusion bonding. For the sake of convenience, FIG. 1 shows an example in which five first heat transfer plates 10 and four second heat transfer plates 20 are alternately stacked. However, the number of heat transfer plates to be stacked is not limited thereto and the number of heat transfer plates to be stacked may be any number. Hereinafter, the stacking direction of the first heat transfer plates 10 and the second heat transfer plates 20 shown in FIG. 1 will be referred to as the direction Z. In addition, a longitudinal direction of the core 1 as seen in the direction Z will be referred to as a direction X and a transverse direction of the core 1 will be referred to as a direction Y, as shown in FIG. 1.

Each of the first heat transfer plates 10 includes a pair of first side end surfaces 10*a* (refer to FIG. 3) and a pair of second side end surfaces 10*b* (refer to FIG. 3) adjacent to the first side end surfaces 10*a* and each of the second heat transfer plates 20 includes a pair of first side end surfaces 20*a* (refer to FIG. 4) and a pair of second side end surfaces 20*b* (refer to FIG. 4) adjacent to the first side end surfaces 20*a*. The first side end surfaces 10*a* and 20*a* are side end surfaces close to short sides and the second side end surfaces 10*b* and 20*b* are side end surfaces close to long sides. Regarding both of the first heat transfer plates 10 and the second heat transfer plates 20, the second side end surfaces 10*b* and 20*b* have a length (length of core 1) L0 and the first side end surfaces 10*a* and 20*a* have a length (width of core 1) W0. Although the first heat transfer plates 10 and the second heat transfer plates 20 have the approximately same thickness t (refer to FIG. 2), the first heat transfer plates 10 and the second heat transfer plates 20 may be different from each other in thickness t. The first heat transfer plates 10 and the second heat transfer plates 20 are formed of, for example, stainless steel. The first heat transfer plates 10 and the second heat transfer plates 20 may be formed of metal other than stainless steel as long as the first heat transfer plates 10 and the second heat transfer plates 20 can be diffusion-bonded to each other.

Figure 2:
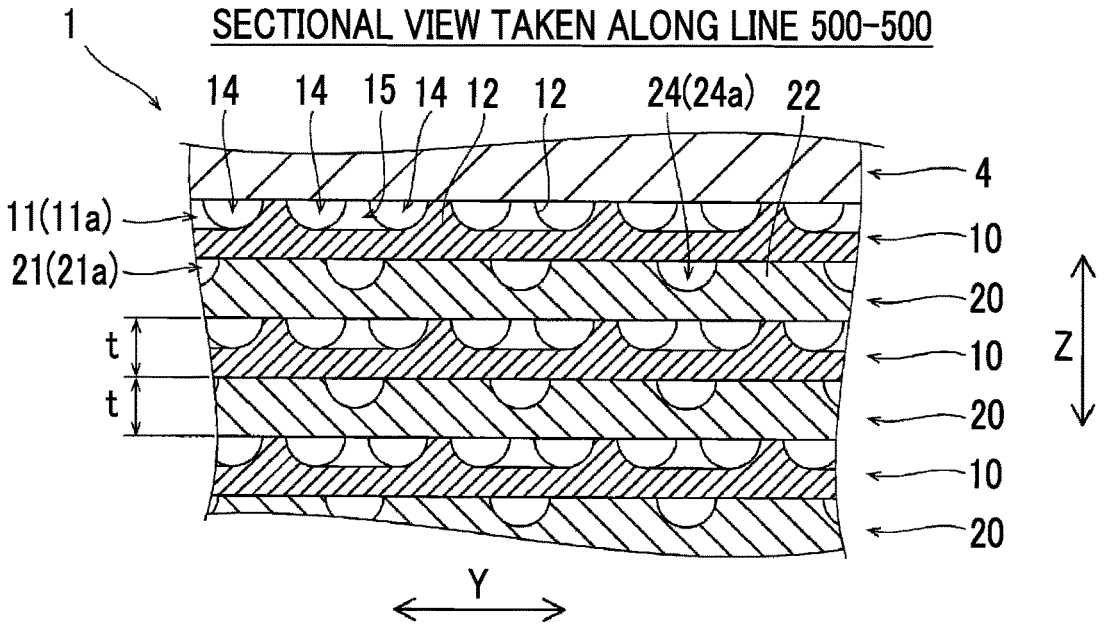
FIG. 2 is a sectional view taken along line 500-500 in FIGS. 3 and 4.

As shown in FIG. 2, a flow path having a groove shape is formed at one surface (upper surface) of each of the first heat transfer plates 10 and the second heat transfer plates 20 and the other surface (lower surface) of each of the first heat transfer plates 10 and the second heat transfer plates 20 is a flat surface. Each first heat transfer plate 10 includes a high-temperature flow path 11 through which the high-temperature fluid HF flows and each second heat transfer plate 20 includes a low-temperature flow path 21 through which the low-temperature fluid LF flows. Each flow path is formed in a predetermined shape through etching, for example. A portion of the one surface (upper surface) of each of the first heat transfer plates 10 and the second heat transfer plates 20 excluding a portion (groove portion) where the flow path is formed is a flat surface and is a surface to be bonded through diffusion bonding.

(First Heat Transfer Plate)

Figure 3:
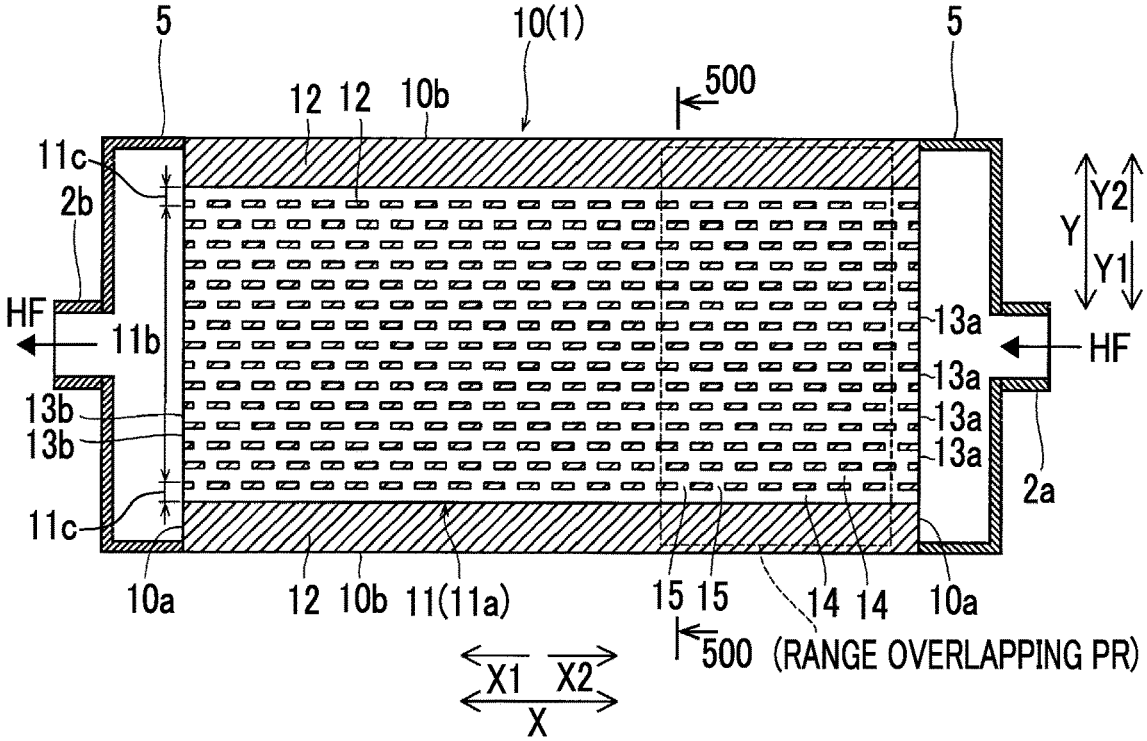
FIG. 3 is a plan view showing a configuration example of a high-temperature flow path of a first heat transfer plate.

As shown in FIG. 3, the first heat transfer plate 10 includes the high-temperature flow path 11 having a groove shape and partition walls 12 defining the high-temperature flow path 11. The partition walls 12 are hatched in FIG. 3 for the sake of convenience. Upper surfaces of the hatched partition walls 12 are surfaces to be bonded through diffusion bonding. The partition walls 12 are a portion of a surface of the first heat transfer plate 10 at which groove formation for forming a flow path is not performed.

The high-temperature flow path 11 is formed to extend in a direction along the second side end surfaces 10*b* from a flow path inlet 13*a* open at the first side end surface 10*a* of the first heat transfer plate 10. The high-temperature flow path 11 is a flow path that linearly extends between the flow path inlet 13*a* and a flow path outlet 13*b* which are open at the pair of first side end surfaces 10*a* of the first heat transfer plate 10 respectively. That is, the high-temperature flow path 11 linearly extends along the second side end surfaces 10*b* (long sides of core 1).

A pair of header portions 5 is bonded to the first side end surfaces 10*a* of the core 1. The pair of header portions 5 is provided to cover the flow path inlets 13*a* or the flow path outlets 13*b* of the stacked first heat transfer plates 10. The pair of header portions 5 is provided with the first inlet port 2*a* and the first outlet port 2*b*. Accordingly, the high-temperature fluid HF flowing in through the first inlet port 2*a* flows into the flow path inlet 13*a* of each of the first heat transfer plates 10 via the header portion 5, passes through the high-temperature flow paths 11 in a direction X1, flows out via the flow path outlets 13*b*, and is discharged from the first outlet port 2*b* via the header portion 5.

(High-Temperature Flow Path)

The high-temperature flow path 11 includes a plurality of channels 14 having a groove shape provided to be arranged in a flow path width direction. The plurality of channels 14 are individual flow path portions that are partitioned in the flow path width direction by the partition walls 12 formed in the high-temperature flow path 11. In an example shown in FIG. 3, sixteen channels 14 are arranged at equal intervals in the flow path width direction. The number of channels 14 is not particularly limited as long as a plurality of channels 14 are provided.

The high-temperature flow path 11 includes a connection channel portion 11*a* configured such that the high-temperature fluid HF can flow across the plurality of channels 14 within at least a range that overlaps a predetermined range PR (refer to FIG. 4) in the stacking direction, the predetermined range PR being a range from a flow path inlet 23*a* of the second heat transfer plate 20 to a position downstream of the flow path inlet 23*a*. That is, each channel 14 is not one independent path from the flow path inlet 13*a* to the flow path outlet 13*b* and the plurality of channels 14 are connected to each other at least in the connection channel portion 11*a*. The predetermined range PR will be described later.

In the first embodiment, the connection channel portion 11*a* is formed over the approximately entire high-temperature flow path 11 in the first heat transfer plate 10. Accordingly, the high-temperature flow path 11 is configured such that the high-temperature fluid HF can flow across the plurality of channels 14 within the entire range from the flow path inlet 13*a* to the flow path outlet 13*b*.

Specifically, the high-temperature flow path 11 includes the plurality of channels 14 having a linear shape arranged in the flow path width direction and in the connection channel portion 11*a*, a plurality of connection paths 15 having a groove shape, each of which extends across the channels 14 adjacent to each other such that the channels 14 communicate with each other, are formed. Each channel 14 is formed to be linear in the direction X. The connection path 15 extends in the flow path width direction (direction Y) such that the connection path 15 penetrates (or divide) the partition wall 12 that partitions the channels 14 adjacent to each other. The plurality of connection paths 15 are provided at intervals in a flowing direction (direction X) of the high-temperature fluid HF. The plurality of connection paths 15 arranged in the direction X are arranged at approximately equal intervals.

Figure 5:
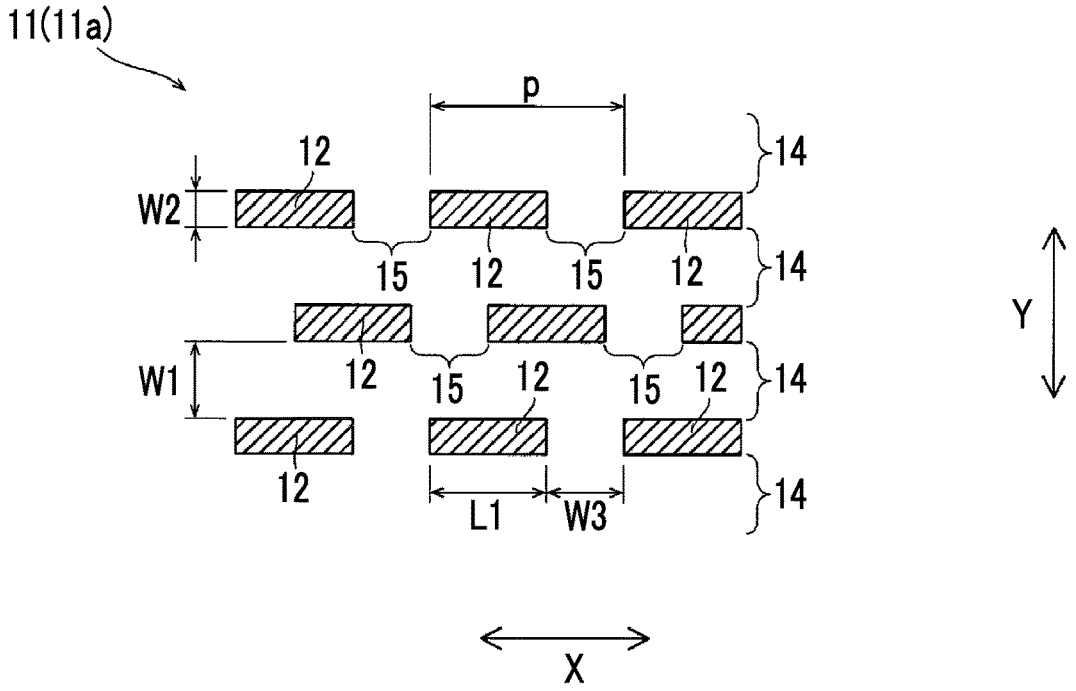
FIG. 5 is a plan view showing a configuration example of a connection channel portion.

As shown in FIG. 5, in the first embodiment, the channels 14 of the high-temperature flow path 11 are approximately the same as each other in channel width W1 (width in flow path width direction). In addition, the partition walls 12 partitioning the channels 14 are also approximately the same as each other in width W2 (width in flow path width direction). The connection paths 15 are approximately the same as each other in path width W3 (width in direction X). Note that, since the connection paths 15 are paths extending in the flow path width direction, the path width W3 refers to a width in a flowing direction (direction X) of a fluid in the high-temperature flow path 11. The length of the connection path 15 in the flow path width direction coincides with the width W2 of the partition wall 12. The pitch (interval) of the plurality of connection paths arranged in the direction X is, p. A length L1 of the partition wall 12 between the connection paths 15 arranged in the direction X is, (p-W3).

In the first embodiment, the path width W3 of the connection path 15 is approximately the same as the channel width W1 of the channel 14 (W3≈W1). Accordingly, it is possible to collectively form the connection paths 15 and the channels 14 by means of the same etching process and thus it is possible to simplify a manufacturing step. It is preferable that the pitch p of the connection paths 15 in the direction X is approximately 2.5 or more times and approximately 10 or less times the channel width W1 of the channel 14. Alternatively, it is preferable that the length L1 of the partition wall 12 between the connection paths 15 adjacent to each other in the direction X is approximately 1.5 or more times and approximately 9 or less times the channel width W1 of the channel 14. As the pitch p (length L1 of partition wall 12) becomes larger, it becomes more difficult for the high-temperature fluid HF to flow across the channels 14 and thus there is a decrease in the flow-around effect of the high-temperature fluid HF with respect to a frozen portion. In addition, since an upper surface of the partition wall 12 between the connection paths 15 is a surface to be bonded to another heat transfer plate (second heat transfer plate 20), as the pitch p (length L1 of partition wall 12) becomes smaller, the bonding area at a partition wall portion between the connection paths 15 becomes smaller and thus there is a decrease in bonding strength. Therefore, the pitch p is made fall within the above-described range and thus it is possible to secure the flow-around effect of the high-temperature fluid HF and a bonding area at the partition wall 12 between the channels 14 at the same time.

FIG. 5 shows an example of the lower limit values in the above-described preferable ranges in which the pitch p of the connection paths 15 in the direction X is approximately 2.5 times the channel width W1 (≈path width W3 of connection path 15) and the length L1 of the partition walls 12 is approximately 1.5 times the channel width W1.

In the first embodiment, the plurality of connection paths 15 are arranged in a zigzag such that the positions of the connection paths 15 adjacent to each other in the flow path width direction (direction Y) are offset from each other in the flowing direction (direction X) of the high-temperature fluid HF. That is, the positions in the direction X of the connection paths 15 formed at the partition walls 12 adjacent to each other in the direction Y alternate. In other words, the connection path 15 is provided to face the partition wall 12 adjacent thereto in the direction Y. Note that, as shown in FIG. 5, the formation positions in the direction X of the connection paths 15 formed at the partition walls 12 adjacent to each other in the direction Y may partially overlap each other and the connection paths 15 may be formed such that the formation positions thereof in the direction X do not overlap each other at all.

(Second Heat Transfer Plate)

Figure 4:
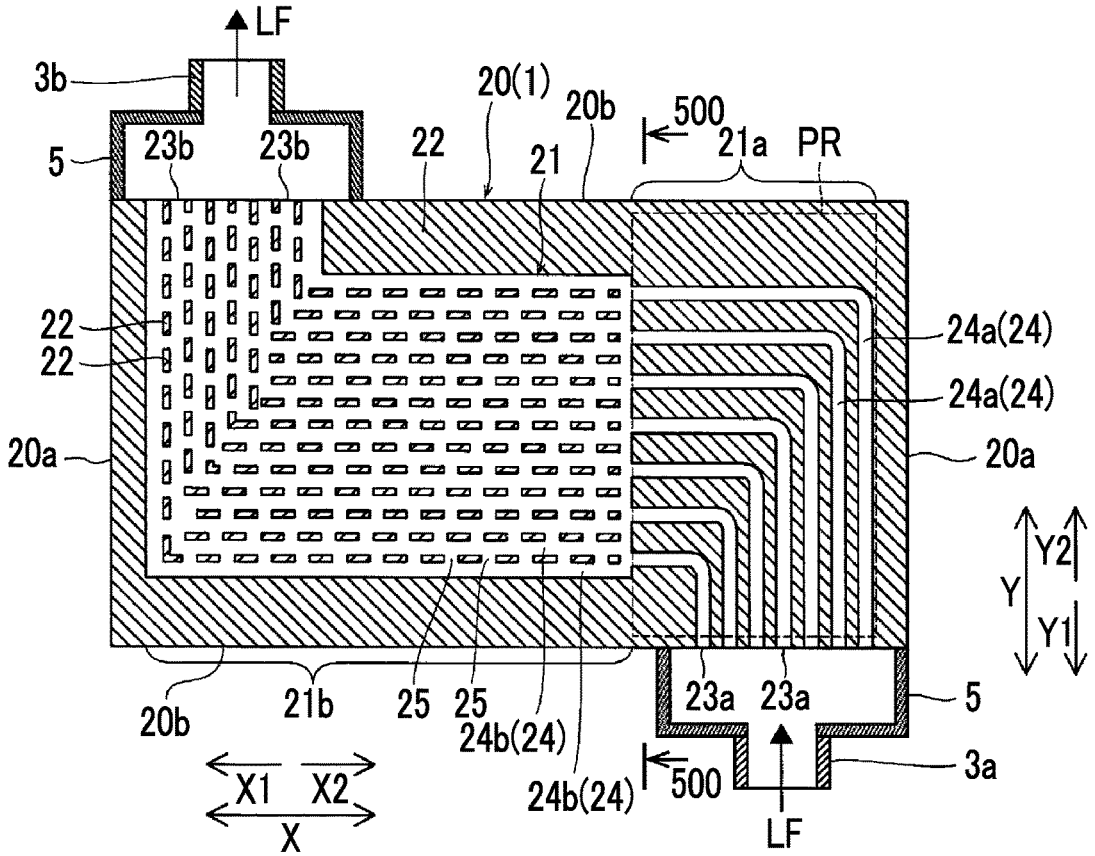
FIG. 4 is a plan view showing a configuration example of a low-temperature flow path of a second heat transfer plate.

As shown in FIG. 4, the second heat transfer plate 20 includes the low-temperature flow path 21 having a groove shape and partition walls 22 defining the low-temperature flow path 21. The partition walls 22 are hatched in FIG. 4 for the sake of convenience. Upper surfaces of the hatched partition walls 22 are surfaces to be bonded through diffusion bonding. The partition walls 22 are a portion of a surface of the second heat transfer plate 20 at which groove formation for forming a flow path is not performed.

The low-temperature flow path 21 is a bent flow path that connects the flow path inlet 23*a* and a flow path outlet 23*b* which are open at the pair of second side end surfaces 20*b* of the second heat transfer plate 20 respectively. The flow path inlet 23*a* of the low-temperature flow path 21 is provided at an end portion of one second side end surface 20*b*, the end portion being on one side (direction X2 side) on which the flow path inlet 13*a* of the high-temperature flow path 11 is disposed. The flow path outlet 23*b* of the low-temperature flow path 21 is provided at an end portion of the other second side end surface 20*b*, the end portion being on the other side (direction X1 side) on which the flow path outlet 13*b* of the high-temperature flow path 11 is disposed.

The low-temperature flow path 21 is bent after extending in the direction Y from the flow path inlet 23*a* open at the one second side end surface 20*b* of the second heat transfer plate 20 and extends in the direction X along the second side end surfaces 20*b* and the low-temperature flow path 21 is bent after extending up to an end portion in the direction X1 and extends in the direction Y up to the flow path outlet 23*b* open at the other second side end surface 20*b*.

A pair of header portions 5 is bonded to the second side end surfaces 20*b* of the core 1. The pair of header portions 5 is provided with the second inlet port 3*a* and the second outlet port 3*b* and is provided to cover the flow path inlets 23*a* or the flow path outlets 23*b* of the stacked second heat transfer plates 20. Accordingly, the low-temperature fluid LF flowing in through the second inlet port 3*a* flows into the flow path inlet 23*a* of each of the second heat transfer plates 20 via the header portion 5, passes through the low-temperature flow paths 21, flows out via the flow path outlets 23*b*, and is discharged from the second outlet port 3*b* via the header portion 5.

(Low-Temperature Flow Path)

The low-temperature flow path 21 includes a plurality of channels 24 having a groove shape provided to be arranged in the flow path width direction. The plurality of channels 24 are individual flow path portions that are partitioned in the flow path width direction by the partition walls 22 formed in the low-temperature flow path 21.

In a configuration example in FIG. 4, the planar shapes of the channels 24 of the low-temperature flow path 21 become different from each other at an intermediate portion of the flow path. That is, in the low-temperature flow path 21, channel shapes switch from a first pattern on an upstream side to a second pattern on a downstream side.

Specifically, the low-temperature flow path 21 includes a first portion 21*a* that is provided in the predetermined range PR of the second heat transfer plate 20 and a second portion 21*b* that is provided downstream of the first portion 21*a* and the first portion 21*a* is configured such that the heat transfer performance of the first portion 21*a* is lower than the heat transfer performance of the second portion 21*b*. In the first embodiment, such a difference in heat transfer performance is realized by a difference in shape pattern of the channels 24.

The first portion 21*a* is provided in the predetermined range PR from the flow path inlet 23*a* of the second heat transfer plate 20 to the position downstream of the flow path inlet 23*a*. Each of channels 24*a* at the first portion 21*a* has a linear shape and the channels 24*a* are separated from each other by the partition walls 22. Therefore, the low-temperature fluid LF does not flow across the plurality of channels 24. In addition, each of the channels 24*a* at the first portion 21*a* is formed in a linear shape except for at a bent portion of the low-temperature flow path 21. That is, each of the channels 24*a* at the first portion 21*a* is bent at the bent portion of the low-temperature flow path 21 after extending linearly in the direction Y from the flow path inlet 23*a* and extends linearly in the direction X. The first pattern of the channel shapes is a pattern in which each of the channels 24 is formed in a single linear shape mainly composed of straight lines.

The second portion 21*b* is provided at a range from a downstream side end portion of the first portion 21*a* (predetermined range PR) to the flow path outlet 23*b* of the second heat transfer plate 20. Each of channels 24*b* at the second portion 21*b* is bent at a bent portion of the low-temperature flow path 21 after extending linearly in the direction X from the downstream side end portion of the first portion 21*a* (predetermined range PR) and extends linearly in the direction Y.

In an example shown in FIG. 4, as with channel shapes in the connection channel portion 11*a* of the high-temperature flow path 11, each of the channels 24*b* at the second portion 21*b* is formed linearly (except for at bent portion of low-temperature flow path 21) and the channels 24*b* adjacent to each other are connected by the connection paths 25. That is, the second pattern of the channel shapes is a pattern in which each of the channels 24*b* is mainly composed of straight lines and the channels 24*b* are connected to each other by the plurality of connection paths 25 arranged in a zigzag. The shape pattern of the channels 24*b* at the second portion 21*b* is the same as that in the connection channel portion 11*a* of the first portion 21*a* except for a point that the low-temperature flow path 21 is bent at an intermediate portion.

Note that, in FIG. 4, a channel width at the first portion 21*a* and a channel width at the second portion 21*b* are approximately the same as each other. The channel width at the first portion 21*a* and the channel width at the second portion 21*b* may be different from each other.

When comparing the first portion 21*a* and the second portion 21*b* with each other, the second portion 21*b* is larger in heat transfer area since the partition walls 22 are divided by the connection paths 25 and the first portion 21*a* is lower in heat transfer performance since the low-temperature fluid LF can flow between the channels 24*b* and thus the flow thereof becomes close to turbulence.

(Positional Relationship Between High-Temperature Flow Path and Low-Temperature Flow Path)

Figure 6:
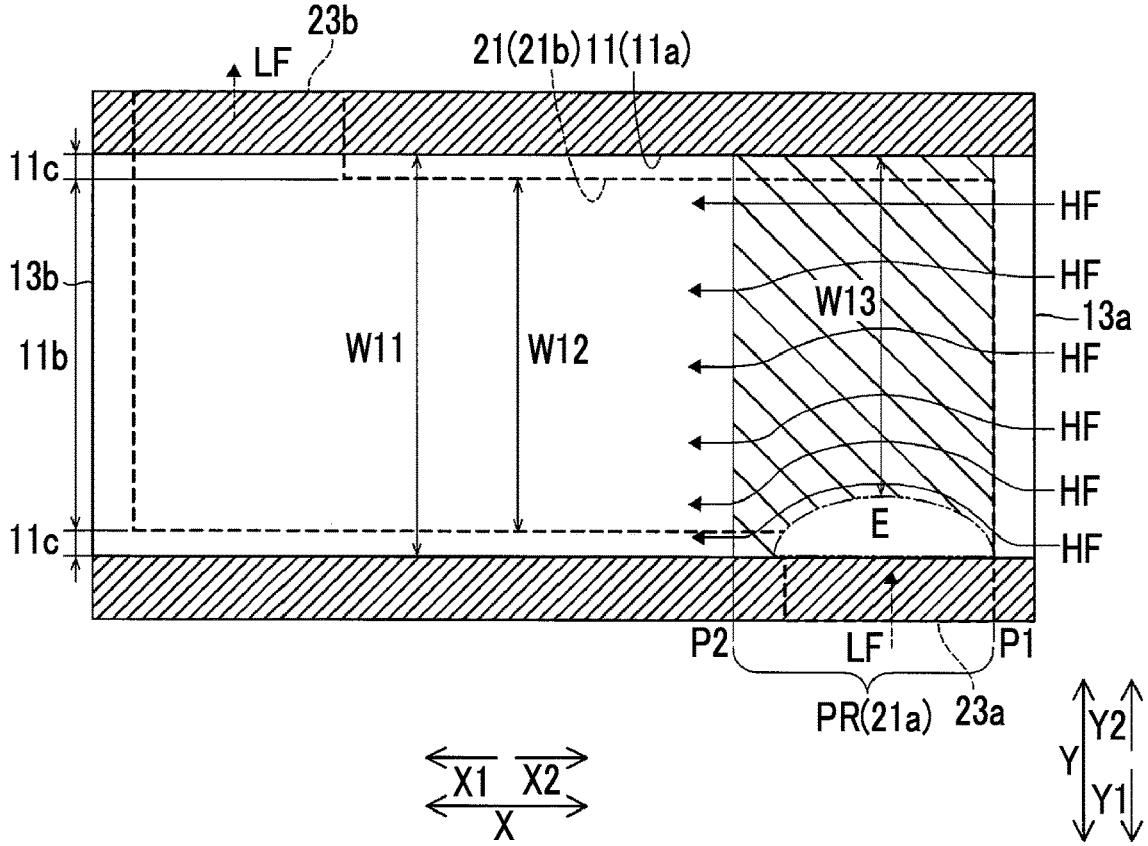
FIG. 6 is a plan view for describing the positional relationship between each part of the high-temperature flow path and each part of the low-temperature flow path.

In FIG. 6, the outer shape of the entire high-temperature flow path 11 is illustrated by means of solid lines and the outer shape of the entire low-temperature flow path 21 is illustrated by means of broken lines such that the high-temperature flow path 11 and the low-temperature flow path 21 overlapping each other are shown. The flow path inlet 23*a* of the low-temperature flow path 21 and the flow path inlet 13*a* of the high-temperature flow path 11 are disposed on one side (direction X2 side) of the core 1 in the direction X and the flow path outlet 23*b* of the low-temperature flow path 21 and the flow path outlet 13*b* of the high-temperature flow path 11 are disposed on the other side (direction X1 side) of the core 1 in the direction X.

As described above, the heat exchanger 100 is a parallel flow heat exchanger in which the flow path inlets of both of the high-temperature flow path 11 and the low-temperature flow path 21 are provided at an end portion on the direction X2 side, the flow path outlets of both of the high-temperature flow path 11 and the low-temperature flow path 21 are provided at an end portion on the direction X1 side, and the high-temperature fluid HF flowing through the high-temperature flow path 11 and the low-temperature fluid LF flowing through the low-temperature flow path 21 flow in the same direction (direction X1). In the high-temperature flow path 11, the high-temperature fluid HF flows in the direction X1 toward the flow path outlet 13*b* on the direction X1 side from the flow path inlet 13*a* on the direction X2 side. In the low-temperature flow path 21, after the low-temperature fluid LF flowing in through the flow path inlet 23*a* on the direction X2 side is bent once and flows in the direction X1, the low-temperature fluid LF is bent again and flows to the flow path outlet 23*b* on the direction X1 side.

(Predetermined Range in Low-Temperature Flow Path)

Next, the predetermined range PR from the flow path inlet 23*a* of the second heat transfer plate 20 to the position downstream of the flow path inlet 23*a*, in which the first portion 21*a* is formed, will be described. As shown in FIG. 6, the high-temperature flow path 11 and the low-temperature flow path 21 overlap each other at the approximately entire region extending in the direction X except for at a region immediately after the flow path inlet 23*a* of the low-temperature flow path 21 and a region immediately before the flow path outlet 23*b* of the low-temperature flow path 21.

Here, the predetermined range PR from the flow path inlet 23*a* of the second heat transfer plate 20 to the position downstream of the flow path inlet 23*a*, in which the first portion 21*a* is formed, is set as a range from a position P1 that is at one end (end portion in direction X2) of the flow path inlet 23*a* in the direction X to a position P2 that is downstream of the other end (end portion in direction X1) of the flow path inlet 23*a* in the direction X and is separated from the other end by a predetermined distance. The predetermined range PR is set to include a high-risk region E where freezing is likely to occur on the high-temperature flow path 11 side because of the low-temperature fluid LF of which the inlet temperature is a very low temperature.

Here, the heat exchanger 100 in the first embodiment is not a general heat exchanger used under random operating conditions and is a type of heat exchanger that is designed such that a predetermined heat exchange performance is achieved under predetermined operating conditions set in advance. Therefore, the position and the range of the high-risk region E are grasped in advance by using an experimental method or an analytical method such as simulation based on operating conditions and design conditions specified in advance. The high-risk region E is a portion where the low-temperature flow path 21 and the high-temperature flow path 11 overlap each other and is a position in the high-temperature flow path 11 that overlaps a position in the vicinity of the flow path inlet 23*a* at which the temperature of the low-temperature fluid LF becomes lowest. The predetermined range PR (first portion 21*a*) of the low-temperature flow path 21 is set as a range that includes the high-risk region E and extends up to a position downstream of the high-risk region E.

Therefore, the connection channel portion 11*a* of the high-temperature flow path 11 is formed over at least a range overlapping the predetermined range PR (first portion 21*a*) of the low-temperature flow path 21. As a result, the connection channel portion 11*a* is provided at a range that includes the high-risk region E where freezing is likely to occur in the high-temperature flow path 11. In addition, the connection channel portion 11*a* is provided to extend in a direction (direction X1) to a downstream side of the low-temperature flow path 21 further than the high-risk region E.

Figure 7:
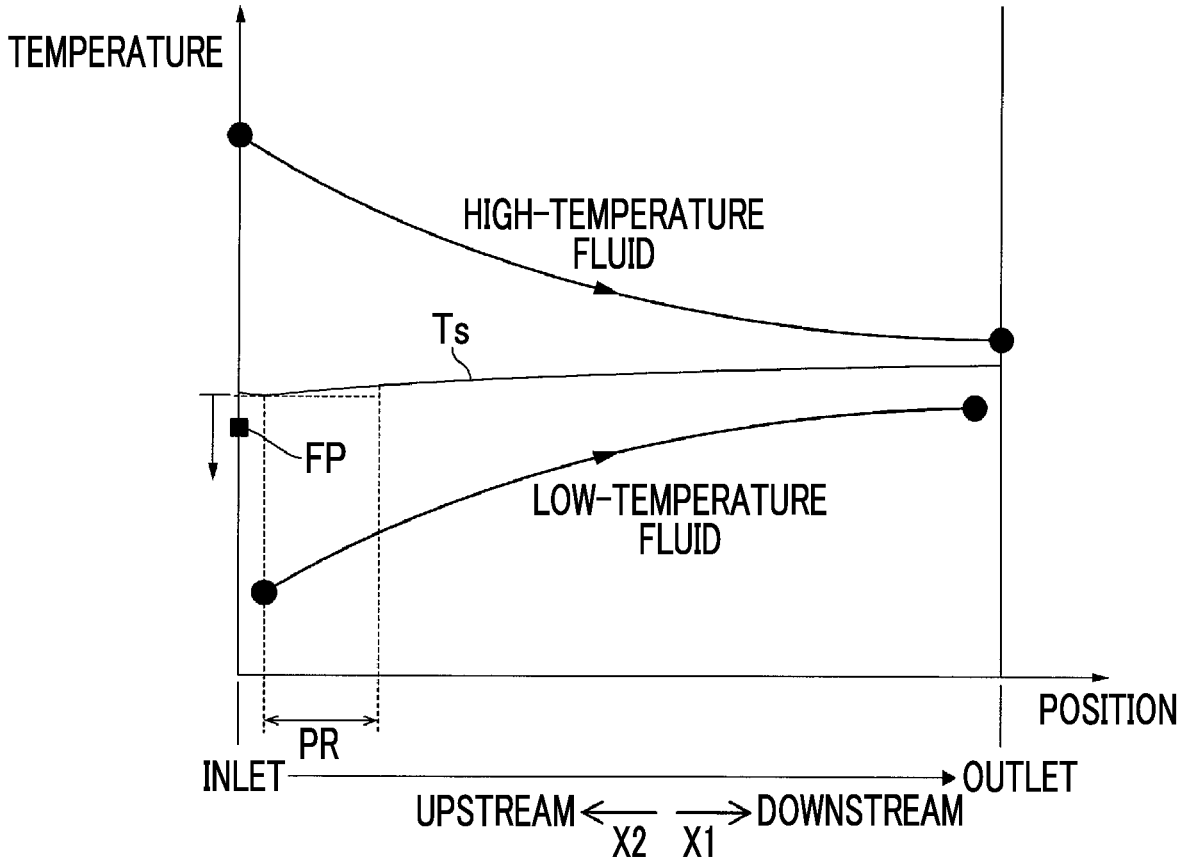
FIG. 7 is a graph illustrating a change in temperature of a fluid along a flow path in a parallel flow heat exchanger.

In addition, in the first embodiment, the shapes of the channels 24*a* (refer to FIG. 4) constituting the first portion 21*a* provided in the predetermined range PR of the low-temperature flow path 21 are set such that a condition that an inner surface temperature Ts of the flow path in the high-risk region E in the high-temperature flow path 11 becomes equal to or greater than a freezing point FP of the high-temperature fluid HF is satisfied. A typical temperature distribution corresponding to a position in the direction X in the parallel flow heat exchanger 100 is shown in FIG. 7. The horizontal axis in FIG. 7 represents the position of each flow path in the direction X and the vertical axis represents the temperature thereof.

The average temperature of the high-temperature fluid HF flowing through the high-temperature flow path 11 and the average temperature of the low-temperature fluid LF flowing through the low-temperature flow path 21 become closer to each other toward a downstream side (direction X1) due to heat exchange, as shown in FIG. 7. In the parallel flow heat exchanger 100, a temperature difference between fluids is largest at a position (predetermined range PR) in the vicinity of the flow path inlet 23*a* of the low-temperature flow path 21, which is an upstream side end portion. However, the inner surface temperature Ts of the high-temperature flow path 11 shown in FIG. 7 is lower than the average temperature of the high-temperature fluid HF and when the inner surface temperature Ts becomes lower than the freezing point FP of the high-temperature fluid HF, there is a possibility that local freezing occurs at a flow path inner surface. The higher the heat transfer performance of the high-temperature flow path 11 is, the higher the inner surface temperature Ts of the high-temperature flow path 11 is and the lower the heat transfer performance of the low-temperature flow path 21, the higher the inner surface temperature Ts is. Therefore, in the first embodiment, the heat exchanger 100 is configured such that the heat transfer performance of the first portion 21*a* is made lower than the heat transfer performance of the second portion 21*b* and the inner surface temperature Ts in the high-risk region E is made higher than the freezing point FP of the high-temperature fluid HF.

(Overlapping Region and Non-Overlapping Region)

As shown in FIG. 6, in the first embodiment, the high-temperature flow path 11 includes an overlapping region 11*b* that overlaps the low-temperature flow path 21 of the second heat transfer plate 20 as seen in plan view and a non-overlapping region 11*c* that is provided outside the overlapping region 11*b* at least on the flow path inlet 23*a* side of the low-temperature flow path 21. In an example shown in FIG. 6, the side close to the flow path inlet 23*a* of the low-temperature flow path 21 is the direction Y1 side in the direction Y.

Specifically, at a portion where each flow path extends in the direction X, the low-temperature flow path 21 of the second heat transfer plate 20 has a flow path width W12 and the high-temperature flow path 11 of the first heat transfer plate 10 has a flow path width W11 larger than the flow path width W12. Therefore, the high-temperature flow path 11 is provided to stick out from the low-temperature flow path 21 in the flow path width direction and a portion of the high-temperature flow path 11 sticking out from the low-temperature flow path 21 is the non-overlapping region 11*c*. The non-overlapping region 11*c* is provided with at least one channel 14 (refer to FIG. 3). In an example shown in FIG. 6, the non-overlapping region 11*c* is provided not only on an outer side on the flow path inlet 23*a* side (direction Y1 side) of the low-temperature flow path 21 but also on an outer side on the flow path outlet 23*b* side (direction Y2 side) of the low-temperature flow path 21. Since the non-overlapping region 11*c* that is provided on the flow path inlet 23*a* side of the low-temperature flow path 21 is adjacent to an outer edge of the low-temperature flow path 21 in the direction Y on the flow path inlet 23*a* side as seen in plan view, the non-overlapping region 11*c* is disposed in the high-risk region E and the vicinity of the high-risk region E.

In the overlapping region 11*b*, the high-temperature flow path 11 and the low-temperature flow path 21 overlap each other in the stacking direction and thus heat exchange is performed between the high-temperature fluid HF and the low-temperature fluid LF flowing through the flow paths respectively.

Meanwhile, in the non-overlapping region 11*c*, the high-temperature flow path 11 and a portion corresponding to the partition walls 22 defining the outer edges of the low-temperature flow path 21 (portion where no low-temperature fluid LF flows) overlap each other in the stacking direction. In comparison with the overlapping region 11*b*, the surplus high-temperature fluid HF of which the degree of contribution to heat exchange with the low-temperature fluid LF is low flows through the channels 14 (refer to FIG. 3) provided at the non-overlapping region 11*c*. Therefore, since the non-overlapping region 11*c* is disposed outside (closer to direction Y1 side than) the overlapping region 11*b*, which overlaps the low-temperature flow path 21, in the flow path width direction, it is possible to cause the surplus high-temperature fluid HF, of which the degree of contribution to normal heat exchange is low, to flow in the high-risk region E and the vicinity of the high-risk region E.

It is preferable that the width of the non-overlapping region 11*c* that is provided on the flow path inlet 23*a* side of the low-temperature flow path 21 is set to such an extent that one to three channels 14 (refer to FIG. 3) of the high-temperature flow path 11 are provided. Since one channel 14 occupies a width of (W1+W2) in consideration of the partition wall 12 between the channels 14, the width of the non-overlapping region 11*c* is set to be approximately one to three times (W1+W2). This is because the heat exchange performance per volume of the heat exchanger 100 is decreased when the non-overlapping region 11*c* is provided more than necessary since the high-temperature fluid HF flowing through the non-overlapping region 11*c* is low in degree of contribution to normal heat exchange as described above.

(Action of First Embodiment)

Next, with reference to FIG. 6, the action of the heat exchanger 100 according to the first embodiment will be described. For the shape of each flow path, refer to FIGS. 3 and 4. When the high-temperature fluid HF and the low-temperature fluid LF flow into the high-temperature flow path 11 and the low-temperature flow path 21 respectively as shown in FIG. 6, heat exchange between the high-temperature fluid HF and the low-temperature fluid LF occurs in a region where the flow paths overlap each other. The high-temperature fluid HF passes through the high-risk region E while passing through a position overlapping the predetermined range PR of the low-temperature flow path 21.

At this time, since the heat transfer performance is relatively low in the first portion 21*a* provided in the predetermined range PR of the low-temperature flow path 21, a decrease in inner surface temperature Ts (refer to FIG. 7) of the high-temperature flow path 11 is suppressed. In addition, regarding a range in the high-temperature flow path 11 that overlaps the predetermined range PR of the low-temperature flow path 21, the connection channel portion 11*a* is provided and thus the heat transfer performance is high and a decrease in inner surface temperature Ts of the high-temperature flow path 11 is suppressed.

There are various variation factors during the operation of the heat exchanger 100 and there is a possibility that the temperature of a fluid (flow path inner surface) is decreased to be lower than the design specification due to a change in operating conditions. In such a case, freezing may occur in the high-risk region E in the high-temperature flow path 11. Therefore, it will be assumed that freezing has occurred in the high-risk region E and the channels 14 at the high-risk region E have been closed.

In this case, since the channels 14 are closed, the flow path width of the high-temperature flow path 11 is decreased to W13 at a frozen portion. As a result, in the channels 14 that are not frozen, the flow rate of the high-temperature fluid HF is increased and thus there is an increase in heat transfer rate. Therefore, expansion of the frozen portion in the direction Y is suppressed.

Meanwhile, in the channels 14 closed due to freezing, the high-temperature fluid HF does not flow to a position downstream of the frozen portion. However, in the connection channel portion 11*a*, the high-temperature fluid HF can flow across the channels 14. When passing through a position beside the frozen portion, the flow path width of the high-temperature flow path 11 is increased from W13 to W11 and thus a stream of the high-temperature fluid HF is expanded in the flow path width direction across the channels 14 as represented by flowlines in FIG. 6. That is, through the channels 14 that are in the vicinity of the frozen portion and are not frozen the high-temperature fluid HF flows in the flow path width direction (direction Y) to flow around the frozen portion up to a position downstream of (behind) the frozen portion. As a result, stagnation of the high-temperature fluid HF at a position downstream of frozen portions of the channels 14 that are closed is suppressed and thus expansion of the frozen portions in the direction X is suppressed.

Furthermore, the non-overlapping region 11*c* which does not overlap the low-temperature flow path 21 is provided near the frozen portion of the high-temperature flow path 11 and the surplus high-temperature fluid HF flows therethrough. Therefore, there is an increase in thermal capacity of the high-temperature fluid HF corresponding to the amount of the surplus high-temperature fluid HF flowing into the channels 14 in the non-overlapping region 11*c*. In addition, even when the channels 14 in the non-overlapping region 11*c* are closed in the high-risk region E due to freezing, a stream of the high-temperature fluid HF is formed downstream of the frozen portion in the non-overlapping region 11*c* since the high-temperature fluid HF flows around the frozen portion. Since the high-temperature fluid HF flowing through the non-overlapping region 11*c* is low in degree of contribution to heat exchange with the low-temperature fluid LF, expansion of the frozen portion is suppressed by a surplus amount of heat of the high-temperature fluid HF.

In addition, even if the frozen portion is expanded beyond the high-risk region E due to a change in operating conditions, since the connection channel portion 11*a* is provided over the entire surface of the high-temperature flow path 11 in the heat exchanger 100 according to the first embodiment, an effect that expansion of the frozen portion is suppressed with the high-temperature fluid HF flowing around the frozen portion is maintained.

In the low-temperature flow path 21, since the heat transfer performance of the first portion 21*a* is lower than that of the second portion 21*b*, an increase in temperature of the low-temperature fluid LF is relatively suppressed in the first portion 21*a*. That is, in comparison with a case where the first portion 21*a* and the second portion 21*b* are composed of channels having the same shape pattern, an increase in temperature of the low-temperature fluid LF is gentle. Meanwhile, when the low-temperature fluid LF flows into the second portion 21*b* beyond the predetermined range PR (first portion 21*a*), since the heat transfer performance is high in the second portion 21*b*, heat exchange with the high-temperature fluid HF is accelerated and thus the temperature of the low-temperature fluid LF is increased up to a target temperature during a process in which the low-temperature fluid LF reaches the flow path outlet 23*b*. At a stage where the low-temperature fluid LF reaches the second portion 21*b*, the temperature of the low-temperature fluid LF is increased to such an extent that the high-temperature fluid HF is not frozen on the high-temperature flow path 11 side. Therefore, in a region overlapping the second portion 21*b* of the high-temperature flow path 11, there is no high-risk region E where freezing occurs.

(Effect of First Embodiment)

According to the first embodiment, the following effects can be achieved.

In the first embodiment, as described above, the connection channel portion 11*a* is provided at least in a range in the high-temperature flow path 11 that overlaps the predetermined range PR from the flow path inlet 23*a* of the second heat transfer plate 20 to a position downstream of the flow path inlet 23*a*. Therefore, it is possible to improve the heat transfer rate in the connection channel portion 11*a*. As a result, there is an increase in amount of heat input to the first heat transfer plate 10 in which the high-temperature flow path 11 is formed and thus the inner surface temperature Ts of the high-temperature flow path 11 can be made high. Therefore, it is possible to suppress freezing in the high-temperature flow path 11. In addition, even in a case where freezing of the high-temperature fluid HF occurs in the connection channel portion 11*a*, expansion of the frozen portion in the direction X can be avoided since the high-temperature fluid HF flowing through another channel 14 can flow around the frozen portion to a downstream side of the channel 14 closed. Furthermore, when a portion of the channels 14 is closed due to freezing, the flow rate of the high-temperature fluid HF in the channels 14 that are not frozen is increased. As a result, the heat transfer rate in the channels 14 that are not frozen is improved and there is an increase in amount of heat input to the first heat transfer plate 10. Therefore, expansion of the frozen portion in the direction Y is suppressed. As a result, it is possible to suppress freezing in a flow path on the high-temperature fluid HF side in a case where a fluid having a very low temperature is handled and to suppress expansion of a frozen region even in the case of freezing.

In addition, since the connection channel portion 11*a* is formed over the approximately entire high-temperature flow path 11 in the first heat transfer plate 10, the effect achieved by the connection channel portion 11*a* can be realized over the entire high-temperature flow path 11 instead of being realized over only the predetermined range PR. As a result, even in a case where a frozen portion different from as expected is generated, it is possible to reliably suppress freezing and expansion of the frozen portion.

In addition, in the connection channel portion 11*a* of the high-temperature flow path 11, the plurality of connection paths 15 having a groove shape, each of which extends across the channels 14 adjacent to each other such that the channels 14 communicate with each other, are formed. Therefore, it is possible to easily configure the connection channel portion 11*a*. Particularly, since the channels 14 and the connection paths 15 can be collectively formed when forming the high-temperature flow path 11 with respect to the first heat transfer plate 10 through etching, it is possible to suppress a manufacturing step being complicated even in a case where the connection channel portion 11*a* is to be provided.

In addition, in the connection channel portion 11*a*, the plurality of connection paths 15 are arranged in a zigzag such that the positions of the connection paths 15 adjacent to each other in the flow path width direction (direction Y) are offset from each other in the flowing direction of the high-temperature fluid HF. Therefore, in comparison with a case where the connection paths 15 are arranged linearly in the flow path width direction, it is possible to cause the high-temperature fluid HF to move in the flow path width direction more efficiently. As a result, it is possible to achieve an improvement in heat transfer efficiency of the connection channel portion 11*a* and to prompt the high-temperature fluid HF to flow around the vicinity of a frozen portion in the connection channel portion 11*a*.

In addition, the high-temperature flow path 11 includes the non-overlapping region 11*c* that is provided outside the overlapping region 11*b* at least on the flow path inlet 23*a* side of the low-temperature flow path 21. Therefore, a stream of the surplus high-temperature fluid HF flowing through the non-overlapping region 11*c*, of which the degree of contribution to heat exchange is low, can be formed near the high-risk region E overlapping the vicinity of the flow path inlet 23*a* of the low-temperature fluid LF. Therefore, it is possible to achieve an increase in thermal capacity of the high-temperature fluid HF corresponding to the amount of the surplus high-temperature fluid HF flowing through the non-overlapping region 11*c*. In addition, even when the non-overlapping region 11*c* is frozen, a stream of the high-temperature fluid HF can be formed at a position downstream of a frozen portion with the high-temperature fluid HF flowing around the frozen portion. As a result, a stream of the surplus high-temperature fluid HF can be formed near the high-risk region E and on a downstream side, and thus freezing of the high-temperature fluid HF in the high-risk region E and expansion of a frozen portion can be effectively suppressed.

In addition, since the first portion 21*a* provided in the predetermined range PR in the low-temperature flow path 21 is configured to have a lower heat transfer performance than the second portion 21*b*, the heat transfer performance of the low-temperature flow path 21 is suppressed by the first portion 21*a* and thus it is possible to increase the inner surface temperature Ts of the high-temperature flow path 11 overlapping the predetermined range PR corresponding thereto. As a result, it is possible to effectively suppress freezing in a portion of the high-temperature flow path 11 that overlaps the predetermined range PR.

In addition, since there is a difference in planar shape such that the heat transfer performance of the channels 24*a* of the first portion 21*a* is lower than the heat transfer performance of the channels 24*b* of the second portion 21*b*, it is possible to easily make the heat transfer performance of the first portion 21*a* lower than the heat transfer performance of the second portion 21*b* only by making the shapes of the channels 24 constituting the low-temperature flow path 21 different from each other as shown in FIG. 4.

In addition, since the heat exchanger 100 in the first embodiment is a parallel flow heat exchanger, the high-temperature fluid HF in a highest-temperature state flows through a position in the high-temperature flow path 11 that overlaps the predetermined range PR and thus freezing of the high-temperature fluid HF can be effectively suppressed. In addition, even in a case where various changes that cannot be grasped in advance are made during the actual operation of the heat exchanger 100, since an inlet temperature is unlikely to be influenced by such variation factors, the influence of the variation factors in the predetermined range PR in which freezing is likely to occur is suppressed and a stable freezing-suppressing effect can be achieved.

Second Embodiment

Next, with reference to FIGS. 8 and 9, a second embodiment will be described. In the second embodiment, an example in which the low-temperature flow path 21 is provided with a plurality of flow path inlets 123*a* unlike the first embodiment, in which the low-temperature flow path 21 of the second heat transfer plate 20 is provided with one flow path inlet 23*a*, will be described. Note that, in the second embodiment, components other than a second heat transfer plate 120, the second inlet port 3*a*, and the second outlet port 3*b* are the same as those in the first embodiment. Therefore, the components are given the same reference numerals and description thereof will be omitted.

Figure 8:
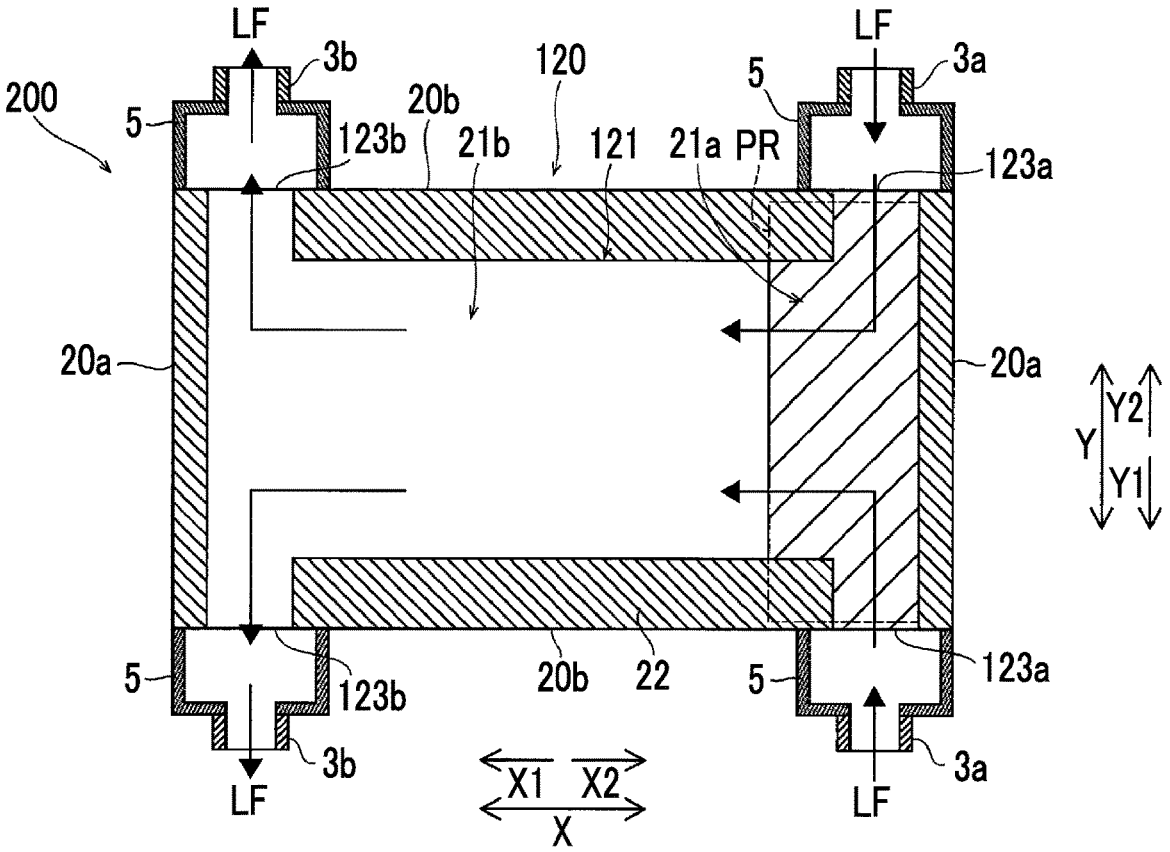
FIG. 8 is a schematic view showing a second heat transfer plate of a heat exchanger according to a second embodiment.

As shown in FIG. 8, in a heat exchanger 200 in the second embodiment, the second heat transfer plate 120 is provided with the plurality of (two) flow path inlets 123*a*. In addition, the second heat transfer plate 120 is provided with a plurality of (two) flow path outlets 123*b*.

The two flow path inlets 123*a* are provided to form a pair (one pair) such that the flow path inlets 123*a* are open at the pair of second side end surfaces 20*b* of the second heat transfer plate 120 respectively. The pair of flow path inlets 123*a* is formed at positions facing each other in the direction Y at an end portion of the second heat transfer plate 120 that is on the direction X2 side.

The two flow path outlets 123*b* are provided to form a pair (one pair) such that the flow path outlets 123*b* are open at the pair of second side end surfaces 20*b* of the second heat transfer plate 120 respectively. The pair of flow path outlets 123*b* is formed at positions facing each other in the direction Y at an end portion that is on the direction X1 side, which is a side opposite to the flow path inlets 123*a*.

In total, four header portions 5 are provided corresponding to the pair of the flow path inlets 123*a* and the flow path outlets 123*b* to cover openings thereof. Each of two header portions 5 covering the flow path inlets 123*a* is provided with the second inlet port 3*a* for introducing the low-temperature fluid LF. Each of two header portions 5 covering the flow path outlets 123*b* is provided with the second outlet port 3*b* for leading out the low-temperature fluid LF.

In the second embodiment, a low-temperature flow path 121 is formed such that the low-temperature flow path 121 is bent after extending from the flow path inlet 123*a* open at each of the pair of second side end surfaces 20*b* of the second heat transfer plate 120 and extends in a direction along the second side end surfaces 20*b*. As described above, in the second embodiment, with respect to the high-temperature flow path 11 (refer to FIG. 9) in which the flow path inlet 13*a* is provided at the first side end surface 20*a* of the first heat transfer plate 10, the pair of flow path inlets 123*a* of the low-temperature flow path 121 is provided at the pair of second side end surfaces 20*b* corresponding to both of right and left sides of the high-temperature flow path 11.

The low-temperature fluid LF is bent after flowing to the center of the low-temperature flow path 121 in the direction Y through the pair of flow path inlets 123*a*, proceeds in the direction X1, branches to opposite sides in the direction Y at an end portion in the direction X1, and flows out through each of the flow path outlets 123*b* on the opposite sides in the direction Y. In a case where the pair of flow path inlets 123*a* is provided on the opposite sides in the direction Y as described above, it is possible to suppress a stream of the low-temperature fluid LF being biased in the low-temperature flow path 121 by providing the pair of flow path outlets 123*b* on the opposite sides in the direction Y in the same manner. Since the opening area (opening width) of each flow path inlet 123*a* can be made small, a local decrease in inner surface temperature Ts in the high-temperature flow path 11 overlapping the low-temperature flow path 121 can be suppressed.

In the case of the low-temperature flow path 121, as with the first embodiment, the first portion 21*a* (hatched portion in low-temperature flow path 121) is provided in the predetermined range PR from the flow path inlets 123*a* of the second heat transfer plate 120 to a position downstream of the flow path inlets 123*a* and the second portion 21*b* is provided downstream of the first portion 21*a*. In addition, the first portion 21*a* is configured to have a lower heat transfer performance than that of the second portion 21*b*. The specific shapes of channels in the first portion 21*a* and the second portion 21*b* are the same as those obtained by making the low-temperature flow path 21 in the first embodiment to branch to right and left sides in the direction Y. Therefore description thereof will be omitted. Therefore, the planar shape of the channels of the first portion 21*a* is different from the planar shape of the channels of the second portion 21*b* such that the heat transfer performance of the channels of the first portion 21*a* is lower than the heat transfer performance of the channels of the second portion 21*b* and detailed description thereof will be omitted.

Figure 9:
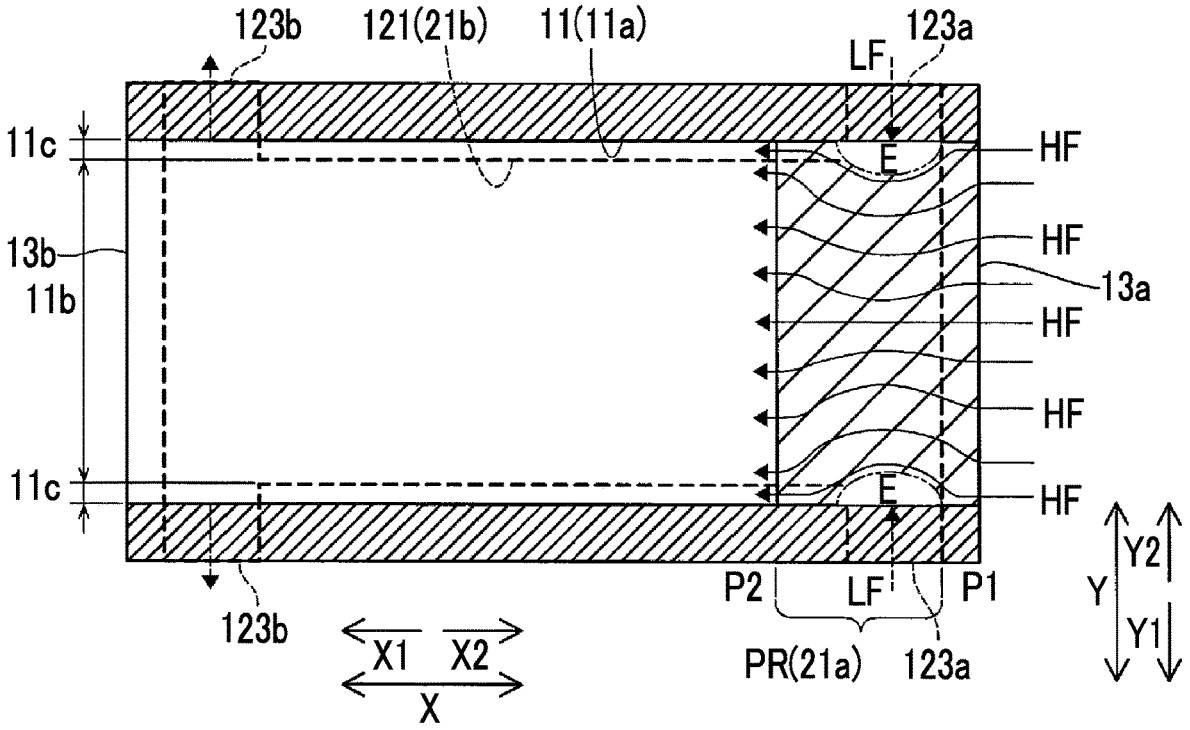
FIG. 9 is a plan view for describing the positional relationship between a high-temperature flow path and a low-temperature flow path of the heat exchanger according to the second embodiment.

FIG. 9 shows the high-temperature flow path 11 (solid lines) and the low-temperature flow path 121 (broken lines) overlapping each other. In the second embodiment, since the low-temperature flow path 121 is provided with the pair of flow path inlets 123*a*, the opening area (opening width) of each flow path inlet 123*a* is approximately half the opening area (opening width) of the flow path inlet 23*a* in the first embodiment. Since the positions of inflow of the low-temperature fluid LF in a very low temperature state are dispersed and the flow rate in each flow path inlet 123*a* is suppressed, the high-risk regions E of the high-temperature flow path 11 are also dispersed into two positions corresponding thereto such that the area thereof is decreased. Therefore, in the heat exchanger 200 in the second embodiment, the high-risk regions E where freezing is likely to occur in the high-temperature flow path 11 are dispersed and made small such that freezing is further suppressed. In addition, even in a case where freezing occurs in each of the high-risk regions E, smaller frozen portions are formed at positions separated from each other in the flow path width direction (direction Y) and thus expansion of each frozen portion can also be effectively suppressed.

The effect achieved by the connection channel portion 11*a* of the high-temperature flow path 11 is the same as that in the first embodiment. As understood from FIGS. 3 to 9, even in a case where freezing occurs in any of two high-risk regions E, the high-temperature fluid HF can flow around the frozen portions by flowing across the channels 14 in the connection channel portion 11*a*.

In the second embodiment, the flow path inlet 123*a* is provided on each of the opposite sides in the direction Y in the low-temperature flow path 121. Therefore, the non-overlapping region 11*c* in the high-temperature flow path 11, which does not overlap the low-temperature flow path 121, is also provided on each of the opposite sides in the direction Y on which the flow path inlets 123*a* are provided.

The other configurations in the second embodiment are the same as those in the first embodiment.

(Effect of Second Embodiment)

In the second embodiment as well, as with the first embodiment, the connection channel portion 11*a* (refer to FIGS. 3 and 9) is provided at least in a range in the high-temperature flow path 11 that overlaps the predetermined range PR from the flow path inlets 123*a* of the second heat transfer plate 120 to a position downstream of the flow path inlets 123*a*. Therefore, it is possible to suppress freezing in a flow path on the high-temperature fluid HF side in a case where a fluid having a very low temperature is handled and to suppress expansion of a frozen region even in the case of freezing.

In addition, in the second embodiment, the low-temperature flow path 121 is formed such that the low-temperature flow path 121 is bent after extending from the flow path inlet 123*a* open at each of the pair of second side end surfaces 20*b* of the second heat transfer plate 120 and extends in the direction X along the second side end surfaces 20*b*. Therefore, with respect to the flow path inlet 13*a* for the high-temperature fluid HF, the flow path inlets 123*a* for the low-temperature fluid LF can be provided at the second side end surfaces 20*b* on both of the right and left sides. Therefore, in comparison with a case where only one flow path inlet 123*a* for the low-temperature fluid LF is provided on one of the right and left sides, it is possible to decrease the opening area of each flow path inlet 123*a* and thus it is possible to disperse the high-risk regions E into both of the right and left sides of the high-temperature flow path 11 while making the high-risk regions E in the high-temperature flow path 11 small. Accordingly, it is possible to suppress freezing and to make a frozen portion small even in the case of freezing.

The other effects of the second embodiment are the same as those of the first embodiment.

(Example of Flow Path Configuration)

Next, a configuration example of the flow paths and the channels will be described. In the first and second embodiments, an example in which the connection channel portion 11*a* of the high-temperature flow path 11 is composed of the linear channels 14 and the connection paths 15, through each of which the channels 14 adjacent to each other communicate with each other, has been described. However, the configuration of the connection channel portion 11*a* is not limited thereto.

Figure 10:
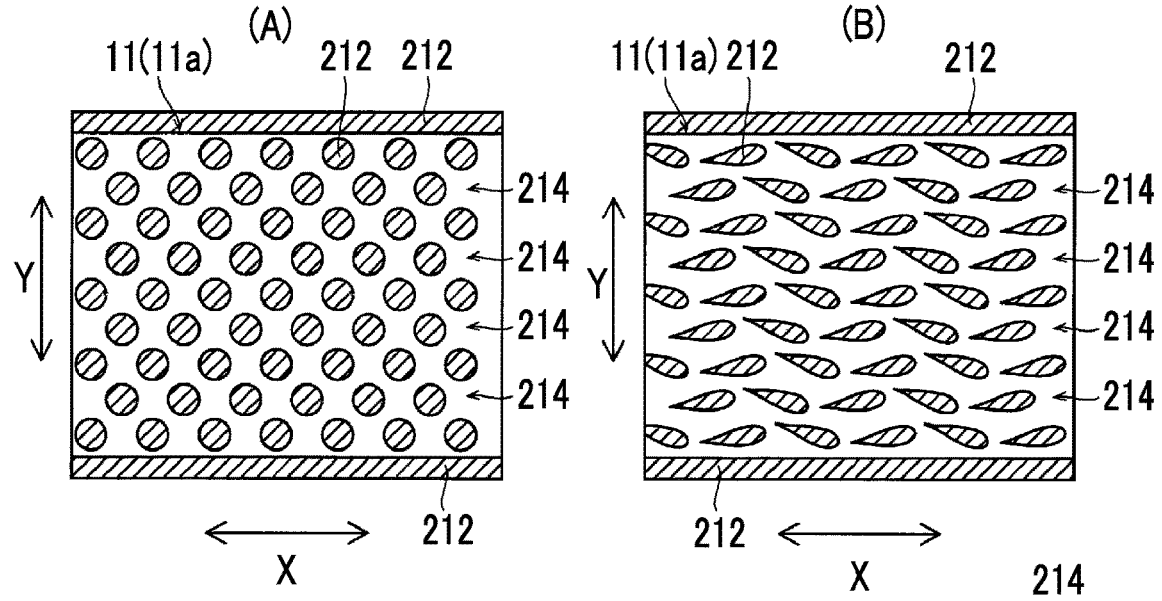
FIG. 10 is a schematic view showing other configuration examples (A) and (B) of the connection channel portion.

For example, as shown in FIGS. 10(A) and 10(B), channels may not be formed linearly. In a configuration example shown in FIGS. 10(A) and 10(B), the high-temperature flow path 11 includes a plurality of channels 214 that branch along a plurality of partition walls 212 having an island shape, which are disposed to be scattered in the flow path, and join each other in the connection channel portion 11*a*. In the configuration example, regarding the channels 214, a space between the partition walls 212, which is defined by the partition walls 212 adjacent to each other, in the flow path width direction (direction Y) orthogonal to the flowing direction (direction X) of the high-temperature fluid HF is defined as one channel.

In a configuration example shown in FIGS. 10(A) and 10(B), the high-temperature flow path 11 includes the plurality of channels 214 that branch along the plurality of partition walls 212 having an island shape, which are disposed to be scattered in the flow path, and join each other in the connection channel portion 11*a*. Therefore, the high-temperature fluids HF can flow across the plurality of channels 214 by branching or joining each other due to the partition walls 212 having the island shape. Therefore, with such a configuration as well, it is possible to configure the connection channel portion 11*a*.

In an example shown in FIG. 10(A), the partition walls 212, which are circular as seen in plan view, are provided in the high-temperature flow path 11 so as to be scattered in an island shape. The partition walls 212 are linearly arranged at predetermined intervals in the flowing direction (direction X) of the high-temperature flow path 11. However, the partition walls 212 are disposed in a zigzag such that the positions of the partition walls 212 constituting rows adjacent to each other in the flow path width direction (direction Y) are offset from each other in the direction X. Therefore, the channels 214 are formed to meander along the partition walls 212 and to repeatedly branch and join each other and thus the high-temperature fluid HF can flow across the channels 214 adjacent to each other.

In an example shown in FIG. 10(B), the partition walls 212, each of which has a wing-like shape as seen in plan view, are provided in the high-temperature flow path 11 so as to be scattered in an island shape. The "wing-like shape" is a sectional shape of a wing of an aircraft or the like and is a shape basically having a rounded leading edge (upstream side edge in flowing direction) and a sharp trailing edge (downstream side edge in flowing direction). The partition walls 212 are linearly arranged at predetermined intervals in the flowing direction (direction X) of the high-temperature flow path 11. However, the partition walls 212 are disposed in a zigzag such that the positions of the partition walls 212 constituting rows adjacent to each other in the flow path width direction (direction Y) are offset from each other in the direction X. In addition, each of the partition walls 212 linearly arranged in the direction X is inclined toward one side or the other side in the direction Y with respect to the direction X and the partition walls 212 are disposed such that the partition walls 212 inclined toward the one side and the partition walls 212 inclined toward the other side are alternately arranged. Note that, the partition walls 212 having a wing shape may be provided to face the same direction as each other without being inclined in the direction Y.

In a configuration example shown in FIG. 10(B) as well, the channels 214 are formed to meander along the partition walls 212 and to repeatedly branch and join each other between the partition walls 212 and thus the high-temperature fluid HF can flow across the channels 214 adjacent to each other.

(Configuration Example of First Portion and Second Portion)

In addition, in the first and second embodiments, an example in which the first portion 21*a* of the low-temperature flow path 21 has a pattern composed of the linear channels 24*a* which are independent of each other and the second portion 21*b* has a pattern in which the linear channels 24*b* communicate with each other through the plurality of connection paths 25 as with the connection channel portion 11*a* has been described. However, the channels in the first portion 21*a* and the second portion 21*b* may be formed in patterns as shown in FIGS. 11(A) and 11(B).

Figure 11:
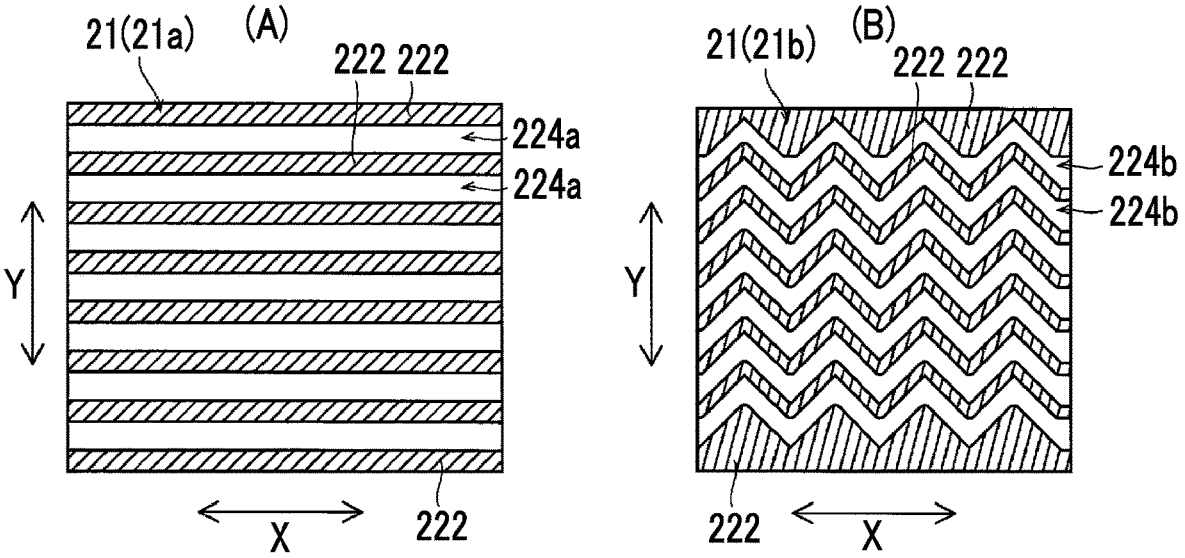
FIG. 11 is a schematic view showing other configuration examples of a first portion (A) and a second portion (B) of the low-temperature flow path.

FIG. 11(A) shows the pattern of the first portion 21*a* and as with the first and second embodiments, partition walls 222 constitute linear channels 224*a* that are independent of each other. On the other hand, FIG. 11(B) shows the pattern of the second portion 21*b* and channels 224*b* are linear channels that are made independent of each other by the partition walls 222 unlike the first and second embodiments. However, each of the channels 224*b* in FIG. 11(B) has a shape that meanders in a zigzag shape by being alternately inclined in the flow path width direction (direction Y). In this case as well, the path length of the channels 224*a* of the first portion 21*a* is longer than that of the zigzag channels 224*b* of the second portion 21*b* and the channel inner surface area thereof is small. Therefore, the heat transfer performance is relatively low. In addition, the channels 224*b* of the second portion 21*b* may have shapes as shown in FIG. 10(A) or FIG. 10(B).

Modification Example

Note that, the embodiments disclosed herein are merely illustrative in all aspects and should not be recognized as being restrictive. The scope of the present invention is defined by the scope of the claims instead of the description in the embodiments, and is intended to include meaning equivalent to the scope of the claims and all modifications (modification examples) within the scope.

For example, in the first and second embodiments, an example of the parallel flow heat exchanger 100 in which a fluid passing through the first heat transfer plate 10 and a fluid passing through the second heat transfer plate 20 flow in the same direction as each other has been described. However, the present invention is not limited thereto. In the present invention, the heat exchanger may be a counterflow heat exchanger in which a fluid passing through the first heat transfer plate 10 and a fluid passing through the second heat transfer plate 20 flow in opposite directions or a crossflow heat exchanger the fluids intersect each other.

In addition, in the first and second embodiments, an example in which the high-temperature flow path 11 and the low-temperature flow path 21 are configured such that a fluid flows into a heat transfer plate through one end side (direction X2 side) of the heat transfer plate and flows out through the other end side (direction X1 side) has been described. However, the present invention is not limited thereto. The high-temperature flow path and the low-temperature flow path may be configured to extend reversely by turning back one time or a plurality of times. For example, the high-temperature flow path 11 and the low-temperature flow path 21 may be configured such that a fluid flows into a heat transfer plate through one end side (direction X2 side) of the heat transfer plate, turns back at the other side (direction X1 side) one time, returns to the one side (direction X2 side), and flows out.

In addition, in the first and second embodiments, an example in which the plurality of first heat transfer plates 10 and the plurality of second heat transfer plates 20 are alternately stacked to constitute the core 1 has been described. However, the present invention is not limited thereto. In the present invention, the first heat transfer plates and the second heat transfer plates may not be alternately stacked. For example, two (plurality of) second heat transfer plates may be stacked with respect to one first heat transfer plate such that the first heat transfer plates and the second heat transfer plates are arranged in the order of the second heat transfer plate, the first heat transfer plate, the second heat transfer plate, the second heat transfer plate, the first heat transfer plate, . . . and so forth along the direction Z. On the contrary, one second heat transfer plate may be stacked with respect to two (plurality of) first heat transfer plates.

In addition, in the first and second embodiments, an example in which the connection channel portion 11*a* is provided over the entire high-temperature flow path 11 has been described. However, the present invention is not limited thereto. In the present invention, the connection channel portion 11*a* may be provided at least over a range in the high-temperature flow path 11 that overlaps the predetermined range PR and the connection channel portion 11*a* may not be provided over a range not overlapping the predetermined range PR. Therefore, the high-temperature flow path 11 may be divided into a first portion and a second portion as with the low-temperature flow path 21, the first portion may be provided with the connection channel portion 11*a*, and the second portion may be provided with channels (for example, refer to FIGS. 11(A) and 11(B)) that are independent of each other such that the high-temperature fluid HF cannot flow across the channels.

In addition, in the first and second embodiments, an example in which the plurality of connection paths 15 of the connection channel portion 11*a* are provided to be disposed in a zigzag has been described. However, the present invention is not limited thereto. In the present invention, the plurality of connection paths 15 may be linearly arranged in the flow path width direction (direction Y), may be regularly dispersed in a shape different from a zigzag shape and a linear shape, and may be dispersed irregularly (randomly).

Figure 12:
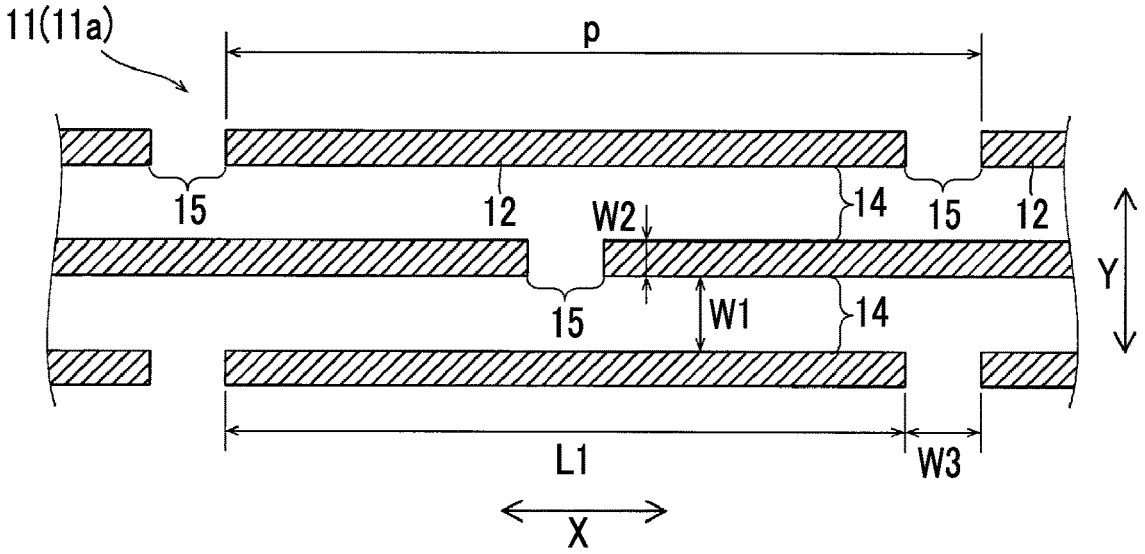
FIG. 12 is a schematic view showing a modification example related to the arrangement of connection paths at the connection channel portion.

In addition, in the first and second embodiments, an example in which the pitch p of the connection paths 15 in the direction X is approximately 2.5 times the channel width W1 and the length L1 of the partition wall 12 is approximately 1.5 times the channel width W1 as shown in FIG. 5 has been described. However, the present invention is not limited thereto. The pitch p of the connection paths 15 in the direction X may be any value falling in a range from a value that is approximately 2.5 or more times the channel width W1 of the channel 14 to a value that is approximately 10 or less times the channel width W1 of the channel 14. In addition, the length L1 of the partition wall 12 between the connection paths 15 adjacent to each other may be any value falling in a range from a value that is approximately 1.5 or more times the channel width W1 of the channel 14 and a value that is approximately 9 or less times the channel width W1 of the channel 14. For example, FIG. 12 shows an example of the upper limit values in the above-described preferable ranges in which the pitch p of the connection paths 15 in the direction X is approximately 10 times the channel width W1 and the length L1 of the partition walls 12 is approximately 9 times the channel width W1 (=path width W3 of connection path 15). The pitch p of the connection paths 15 in the direction X or the length L1 of the partition wall 12 between the connection paths 15 adjacent to each other may not fall in the above-described ranges.

In addition, in the first and second embodiments, an example in which the high-temperature flow path 11 is provided with the non-overlapping region 11*c* that is provided outside the overlapping region 11*b* has been described. However, the present invention is not limited thereto. In the present invention, the non-overlapping region may not be provided.

In addition, in the first and the second embodiments, an example in which the low-temperature flow path 21 is provided with the first portion 21*a* and the second portion 21*b* has been described. However, the present invention is not limited thereto. In the present invention, the low-temperature flow path 21 may not be provided with the first portion 21*a* and the second portion 21*b* and the low-temperature flow path 21 may be composed of the channels 14 in a single pattern.

In addition, in the first and second embodiments, an example in which the planar shapes of the channels 14 of the first portion 21*a* and the channels 14 of the second portion 21*b* are made different from each other such that the heat transfer performance of the first portion 21*a* is made relatively low has been described. However, the present invention is not limited thereto. For example, a surface treatment such as coating, which lowers the heat transfer performance, may be performed only on inner surfaces of the channels 14 of the first portion 21*a* such that the heat transfer performance of the first portion 21*a* is made relatively low.

REFERENCE SIGNS LIST

1 core
10 first heat transfer plate
10*a* first side end surface
10*b* second side end surface
11 high-temperature flow path
11*a* connection channel portion
11*b* overlapping region
11*c* non-overlapping region
13*a* flow path inlet (flow path inlet of high-temperature flow path)
13*b* flow path outlet (flow path outlet of high-temperature flow path)
14, 214 channel
15 connection path
20, 120 second heat transfer plate
20*a* first side end surface
20*b* second side end surface
21, 121 low-temperature flow path
21*a* first portion
21*b* second portion
23*a*, 123*a* flow path inlet (flow path inlet of low-temperature flow path)
23*b*, 123*b*2 flow path outlet (flow path outlet of low-temperature flow path)
24, 24*a*, 24*b*, 224*a*, 224*b* channel
100, 200 heat exchanger (diffusion bonding heat exchanger)
212 partition wall (partition wall having island shape)
HF high-temperature fluid
LF low-temperature fluid
PR predetermined range

The invention claimed is:

1. A method of operating a diffusion bonding heat exchanger having a core that includes a first heat transfer plate and a second heat transfer plate that are stacked and diffusion-bonded to each other, and a header portion covering a side surface of the core, wherein the first heat transfer plate includes a high-temperature flow path that includes a plurality of first channels having a groove shape in a flow path width direction, the second heat transfer plate includes a low-temperature flow path which includes a plurality of second channels, the high-temperature flow path of the first heat transfer plate includes a connection channel portion within at least a range that overlaps a predetermined range in a stacking direction, the predetermined range being a range from a flow path inlet of the second heat transfer plate to a position downstream of the flow path inlet of the second heat transfer plate, each of the plurality of first channels of the high temperature flow path has a first heat transfer plate flow path inlet open on a side end surface of the first heat transfer plate at an inlet header, in the connection channel portion of the high-temperature flow path, a plurality of connection paths having a groove shape, each of which extends across the channels of the plurality of first channels which are adjacent to each other such that the channels communicate with each other, are formed at intervals in a direction along the plurality of first channels, the low-temperature flow path includes a first portion that is provided in the predetermined range of the second heat transfer plate and a second portion that is provided downstream of the first portion, the channels of the first portion of the plurality of second channels are not connected to one another, each of the channels of the second portion of the plurality of second channels are connected by connecting paths, and the second portion of the plurality of second channels is larger in heat transfer area than a heat transfer area of the first portion of the plurality of second channels, the method comprising the steps of:

introducing a high-temperature fluid from the inlet header into the plurality of channels of the high-temperature flow path channel inlets;

introducing a low-temperature fluid having a temperature which is lower than a freezing point of the high-temperature fluid into inlets of the plurality of second channels of the low-temperature flow path; and controlling a flow rate of the high-temperature fluid in the high-temperature flow path, a flow rate of the low-temperature fluid in the low-temperature flow path, a temperature of the high-temperature fluid entering the high-temperature flow path channel inlets, a temperature of the low-temperature fluid entering the high-temperature flow path channel inlets, or a combination of one or more thereof, such that the high-temperature fluid temperature is maintained above the freezing temperature of the high-temperature fluid in the connection channel portion in the predetermined range.

2. The method according to claim 1, wherein the connection channel portion is formed over the approximately entire high-temperature flow path in the first heat transfer plate.

3. The method according to claim 1, wherein the plurality of connection paths are arranged in a zigzag such that positions of the connection paths adjacent to each other in the flow path width direction are offset from each other in a flowing direction of the high-temperature fluid.

4. The method according to claim 1, wherein the low-temperature flow path includes a first portion that is provided in the predetermined range of the second heat transfer plate and a second portion that is provided downstream of the first portion, the low-temperature flow path includes a plurality of channels having a groove shape through which the low-temperature fluid flows, and a planar shape of the channels of the first portion is different from a planar shape of the channels of the second portion such that a heat transfer surface in a unit area size of the channels of the first portion is smaller than a heat transfer surface in the unit area size of the channels of the second portion.

5. The method according to claim 1, wherein the diffusion bonding heat exchanger is a parallel flow heat exchanger in which the high-temperature fluid flowing through the high-temperature flow path and the low-temperature fluid flowing through the low-temperature flow path flow in the same direction.

6. The method according to claim 1, wherein each of the first heat transfer plate and the second heat transfer plate includes a pair of first side end surfaces and a pair of second side end surfaces adjacent to the first side end surfaces, the high-temperature flow path is formed to extend in a direction along the second side end surfaces from a flow path inlet open at the first side end surface of the first heat transfer plate, and the low-temperature flow path is formed such that the low-temperature flow path is bent after extending from the flow path inlet open at each of the pair of second side end surfaces of the second heat transfer plate and extends in the direction along the second side end surfaces.

* * * * *